US011333366B2

(12) United States Patent
Tsukiyama et al.

(10) Patent No.: US 11,333,366 B2
(45) Date of Patent: May 17, 2022

(54) TEMPERATURE ADJUSTMENT APPARATUS, INTERMEDIARY APPARATUS, LOAD APPARATUS, AND REFRIGERATION CYCLE APPARATUS

(71) Applicant: Mitsubishi Electric Corporation, Tokyo (JP)

(72) Inventors: Ryo Tsukiyama, Tokyo (JP); Masahiro Ito, Tokyo (JP); So Nomoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 19 days.

(21) Appl. No.: 16/635,912

(22) PCT Filed: Sep. 4, 2017

(86) PCT No.: PCT/JP2017/031738

§ 371 (c)(1),
(2) Date: Jan. 31, 2020

(87) PCT Pub. No.: WO2019/043935

PCT Pub. Date: Mar. 7, 2019

(65) Prior Publication Data

US 2020/0232657 A1 Jul. 23, 2020

(51) Int. Cl.

| | |
|---|---|
| ***F24F 1/0007*** | (2019.01) |
| ***F24F 11/84*** | (2018.01) |
| ***F25B 29/00*** | (2006.01) |

(52) U.S. Cl.

CPC ..... *F24F 1/00077* (2019.02); *F24F 11/84* (2018.01); *F25B 29/00* (2013.01); *F25B 2313/003* (2013.01)

(58) Field of Classification Search

CPC ..... F24F 1/00077; F24F 11/84; F24F 13/30; F25B 2313/003; F24D 3/00

See application file for complete search history.

(56) References Cited

U.S. PATENT DOCUMENTS

2012/0018129 A1* 1/2012 Ushijima ..... F24D 3/18 165/104.19

2015/0285519 A1 10/2015 Motomura et al.

FOREIGN PATENT DOCUMENTS

EP 2 413 042 A1 2/2012
EP 2 489 774 A1 8/2012

(Continued)

OTHER PUBLICATIONS

Extended European Search Report dated Jul. 28, 2020 for the corresponding EP patent application No. 17923958.7.

(Continued)

*Primary Examiner* — Lionel Nouketcha

(74) *Attorney, Agent, or Firm* — Posz Law Group, PLC

(57) ABSTRACT

A temperature adjustment apparatus adjusts a temperature of a heating medium that exchanges heat with air in an indoor heat exchanger connected to a heat source apparatus. It includes a first and second pipes through which the heating medium flows, the second pipe being branched into a first and second branch pipes which are thereafter merged, a second heat exchanger in which heat is exchanged between the heating medium in the first branch pipe and the heating medium in the first pipe, and a flow rate regulator that changes a flow rate of the heating medium in the first branch pipe and a flow rate of the heating medium in the second branch pipe. The second pipe supplies the heating medium from the heat source apparatus to the indoor heat exchanger. The first pipe returns the heating medium from the indoor heat exchanger to the heat source apparatus.

15 Claims, 16 Drawing Sheets

(56) References Cited

FOREIGN PATENT DOCUMENTS

| | | | | |
|---|---|---|---|---|
| JP | 2001-147022 | A | | 5/2001 |
| JP | 2001147022 | A | * | 5/2001 |
| JP | 5855279 | B2 | | 2/2016 |

OTHER PUBLICATIONS

International Search Report of the International Searching Authority dated Nov. 28, 2017 for the corresponding international application No. PCT/JP2017/031738 (and English translation).

* cited by examiner

TEMPERATURE ADJUSTMENT APPARATUS, INTERMEDIARY APPARATUS, LOAD APPARATUS, AND REFRIGERATION CYCLE APPARATUS

CROSS REFERENCE TO RELATED APPLICATION

This application is a U.S. national stage application of PCT/JP2017/031738 filed on Sep. 4, 2017, the contents of which are incorporated herein by reference.

TECHNICAL FIELD

The present invention relates to a temperature adjustment apparatus, and particularly to a temperature adjustment apparatus configured to adjust a temperature of a liquid medium that exchanges heat with air in an indoor heat exchanger and an intermediary apparatus, a load apparatus, and a refrigeration cycle apparatus that include the same.

BACKGROUND ART

An air-conditioning system configured to cool and warm a room by generating cold and hot water by means of a heat source apparatus such as a heat pump and delivering cold and hot water to an indoor unit by means of a water pump has conventionally been known. For such an air-conditioning system, a system configured to send water with a temperature of water being constant regardless of an air-conditioning load, for example, by supplying cold water at 16° C. to the indoor unit in cooling and supplying hot water at 35° C. to the indoor unit in warming, is generally employed. According to such a system, under a low air-conditioning load, when a temperature of the room attains to a set value, a valve stops delivery of water to the indoor unit and an operation is intermittent. Therefore, the temperature of the room is varied, comfort is compromised, and operation efficiency is lowered.

According to some air-conditioning systems, a temperature of water supplied to the indoor unit is varied by a heat source apparatus depending on a load. In such air-conditioning systems, a plurality of indoor units generally simultaneously air-condition a plurality of rooms. When loads are different among the plurality of rooms, a temperature of water and the load do not match in some rooms, and insufficient performance where a temperature of water is low relative to a load or excessive performance in which a temperature of water is high relative to a load occurs. Then, comfort is compromised and operation efficiency is lowered.

In order to solve this problem, an air-conditioning system disclosed in Japanese Patent No. 5855279 (PTL 1) controls a flow rate of cold and hot water by using a flow rate regulator such that a flow rate of cold and hot water that flows into each room is set to a flow rate necessary for covering an air-conditioning load required in the room.

CITATION LIST

Patent Literature

PTL 1: Japanese Patent No. 5855279

SUMMARY OF INVENTION

Technical Problem

In general, cooling capability of an air-conditioning system can be categorized into two of sensible heat processing for lowering a temperature and latent heat processing for lowering an absolute humidity. When lowering in temperature of a space to be air-conditioned to a target value is desired, preferably, of cooling capability, only an amount of processing of latent heat is reduced while an amount of processing of sensible heat is maintained constant. In that case, even though a set temperature of the room is the same, total cooling capability exhibited by an indoor unit can be low. Consequently, capability of the heat source apparatus can be low and electric power consumed by the air-conditioning system can be less.

In the air-conditioning system disclosed in Japanese Patent No. 5855279 (PTL 1), cooling capability corresponding to an air-conditioning load is adjusted by regulation of a flow rate in an individual indoor unit. In this case, in lowering a temperature of the room to a target temperature, a ratio of an amount of processing of latent heat of cooling capability increases. Therefore, cooling capability exhibited by the indoor unit becomes excessive and electric power consumed by the heat source apparatus disadvantageously increases. In addition, a humidity is lowered by unnecessary latent heat processing and such dryness in the room leads to discomfort of a user.

The present invention was made to solve the problems above, and an object thereof is to provide a temperature adjustment apparatus, an intermediary apparatus, a load apparatus, and a refrigeration cycle apparatus that achieve improved energy saving performance and improved comfort.

Solution to Problem

The present disclosure relates to a temperature adjustment apparatus configured to adjust a temperature of a heating medium that exchanges heat with air in an indoor heat exchanger connected to a heat source apparatus. The temperature adjustment apparatus includes a first pipe through which the heating medium flows, a second pipe through which the heating medium flows, the second pipe being branched into a first branch pipe and a second branch pipe, the first branch pipe and the second branch pipe being thereafter merged again, a second heat exchanger in which heat is exchanged between the heating medium that flows through the first branch pipe and the heating medium that flows through the first pipe, and a flow rate regulator configured to change a flow rate of the heating medium that flows through the first branch pipe and a flow rate of the heating medium that flows through the second branch pipe.

One of the first pipe and the second pipe is a pipe configured to supply the heating medium from the heat source apparatus to the indoor heat exchanger and the other of the first pipe and the second pipe is a pipe configured to return the heating medium from the indoor heat exchanger to the heat source apparatus.

Advantageous Effects of Invention

Since the temperature adjustment apparatus in the present disclosure can finely adjust a temperature of liquid refrigerant supplied to an indoor heat exchanger, it can achieve improved temperature adjustment performance while energy saving performance of a refrigeration cycle apparatus is maintained.

DESCRIPTION OF EMBODIMENTS

Figure 1:
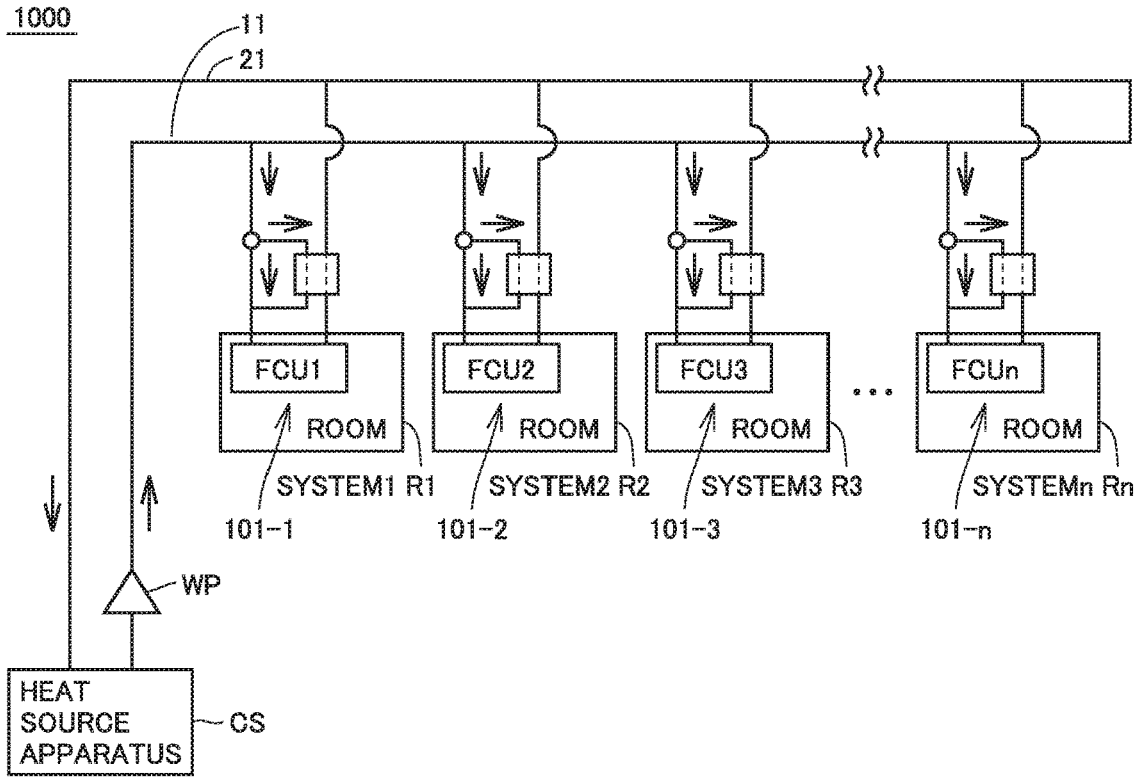
FIG. 1 is a diagram showing an overall configuration of an air-conditioning system to which a temperature adjustment apparatus in the present embodiment is applied.

Embodiments of the present invention will be described below in detail with reference to the drawings. Though a plurality of embodiments will be described below, combination as appropriate of features described in the embodiments is originally intended. The same or corresponding elements in the drawings have the same reference characters allotted.

First Embodiment

FIG. 1 is a diagram showing an overall configuration of an air-conditioning system to which a temperature adjustment apparatus in the present embodiment is applied. Referring to FIG. 1, an air-conditioning system 1000 includes a heat source apparatus CS, a pump WP, load apparatuses 101-1 to **101-*n***, and a pipe.

Heat source apparatus CS is an apparatus configured to cool or heat a heating medium to be supplied to load apparatuses 101-1 to **101-*n*. The heating medium is supplied to load apparatuses 101-1 to 101-*n* from heat source apparatus CS through a trunk pipe 11 for supply of the heating medium from heat source apparatus CS to load apparatuses 101-1 to 101-*n* and returned to heat source apparatus CS from load apparatuses 101-1 to 101-*n* through a trunk pipe 21 that recovers the heating medium from load apparatuses 101-1 to 101-*n* to heat source apparatus CS. Pump WP circulates the heating medium that passes through trunk pipe 11 and trunk pipe 21 through air-conditioning system 1000. Though the "heating medium" is not particularly limited, for example, liquid that does not change in phase such as water or brine representing a liquid medium can be employed. Load apparatuses (fan coil units) 101-1 to 101-*n* are connected in parallel between trunk pipe 11 and trunk pipe 21** with a connection pipe which will be described later being interposed and arranged in rooms R1 to Rn, respectively.

Figure 2:
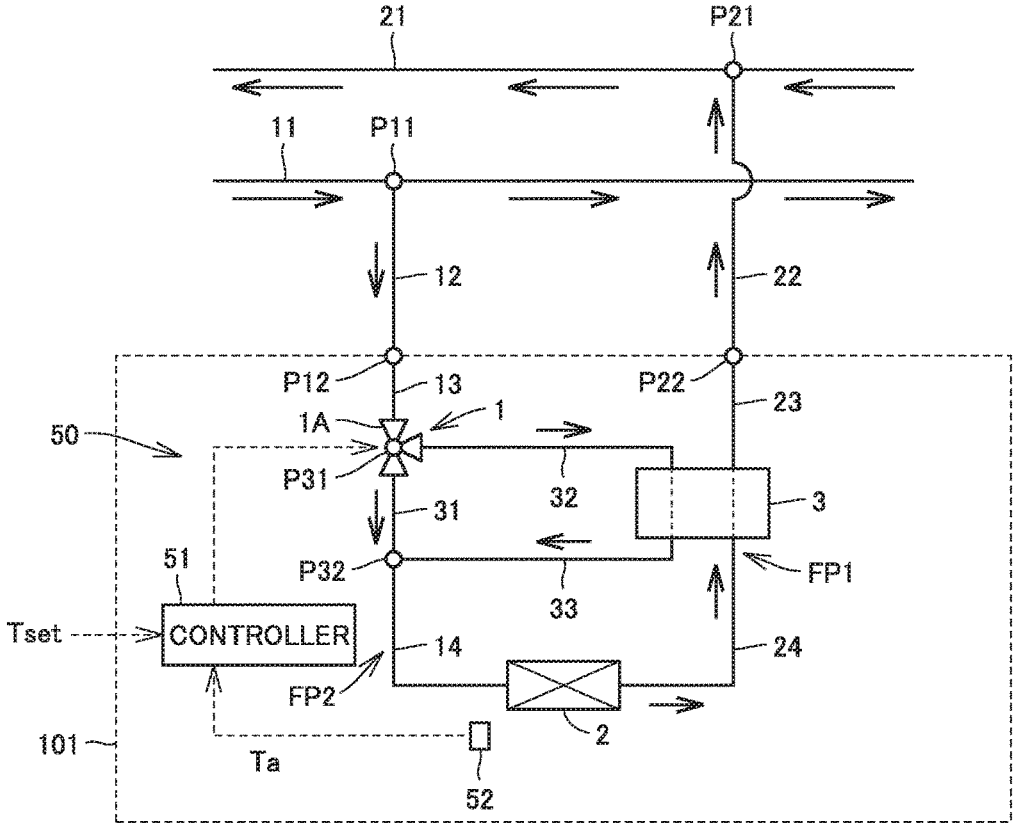
FIG. 2 is a diagram representatively showing a configuration of a load apparatus in FIG. 1 and a flow of a heating medium.

FIG. 2 is a diagram representatively showing a configuration of load apparatuses 101-1 to **101-*n* in FIG. 1 and a flow of a heating medium. Referring to FIG. 2, a load apparatus 101 includes an indoor heat exchanger 2 (a first heat exchanger) representing a heat exchanger in which heat is exchanged between water and air in the room, a temperature adjustment apparatus 50 configured to adjust a temperature of the heating medium that flows through indoor heat exchanger 2, a pipe for circulation of the heating medium to indoor heat exchanger 2 and temperature adjustment apparatus 50, a controller 51, and a temperature sensor 52** for measuring a temperature of a room R.

Load apparatus 101 is connected to trunk pipe 11 and trunk pipe 21 through a connection pipe 12 and a connection pipe 22. Connection pipe 12 has one end connected to a main branch portion P11 which is a branch portion where connection pipe 12 is branched off from trunk pipe 11 and the other end connected to a liquid inlet P12 connected to a pipe provided in load apparatus 101. Connection pipe 22 has one end connected to a main merge portion P21 which is a portion of merge between trunk pipe 21 and connection pipe 22 and the other end connected to a liquid outlet P22 connected to a pipe provided in load apparatus 101.

Temperature adjustment apparatus 50 adjusts a temperature of the heating medium that exchanges heat with air in indoor heat exchanger 2 connected to heat source apparatus CS. Temperature adjustment apparatus 50 includes a pipe FP1 (a first pipe) and a pipe FP2 (a second pipe) through which the heating medium flows, a second heat exchanger 3, and a flow rate regulator 1. Pipe FP2 is branched into first branch pipes 32 and 33 and a second branch pipe 31, the first branch pipes and the second branch pipe being thereafter merged again. Branch pipe 32 and branch pipe 33 communicate with each other with the second heat exchanger being interposed and form one flow path.

Second heat exchanger 3 is configured such that heat is exchanged between the heating medium that flows through pipe FP1 and the heating medium that flows through pipe FP2. Flow rate regulator 1 is configured to change a flow rate of the heating medium that flows through branch pipes 32 and 33 and to change a flow rate of the heating medium that flows through branch pipe 31. In an example shown in FIG. 2, flow rate regulator 1 includes a flow rate distribution valve 1A (a first flow rate distribution valve) arranged in a branch portion P31 where branch pipe 32 and branch pipe 31 are branched off, the flow rate distribution valve being configured to change a ratio between a flow rate of the heating medium that flows through branch pipes 32 and 33 and a flow rate of the heating medium that flows through branch pipe 31. Flow rate distribution valve 1A may be arranged in a merge portion. P32 where branch pipe 33 and branch pipe 31 are merged rather than branch portion P31 where branch pipe 32 and branch pipe 31 are branched off. Unlike a component like a switching valve, flow rate regulator 1 is configured to adjust stepwise or continuously a ratio between the flow rate of the heating medium that flows through branch pipes 32 and 33 and the flow rate of the heating medium that flows through branch pipe 31.

In the example shown in FIG. 2, pipe FP2 defines a flow path for supply of the heating medium from heat source apparatus CS to indoor heat exchanger 2 and pipe FP1 defines a flow path for return of the heating medium from indoor heat exchanger 2 to the heat source apparatus. Pipe FP2 includes pipes 13 and 14 and branch pipes 31, 32, and 33. Pipe FP1 includes pipes 23 and 24.

Branch pipe 32 is branched from pipe 13 configured to guide the heating medium from liquid inlet P12 of load apparatus 101 and serves to supply the heating medium to a first flow path in second heat exchanger 3. Branch pipe 33 serves to send the heating medium that flows out of the first flow path in second heat exchanger 3 to pipe 14. Branch pipe 31 defines a flow path that bypasses a heat exchange path in second heat exchanger 3. Branch pipe 32 and branch pipe 31 are branched off in branch portion P31. Flow rate distribution valve 1A is arranged in branch portion P31. Branch pipe 31 and branch pipe 33 are merged in merge portion P32.

Pipe 14 connects merge portion. P32 and a liquid inlet of indoor heat exchanger 2 to each other. Pipe 24 connects a liquid outlet of indoor heat exchanger 2 and an inlet of a second flow path in second heat exchanger 3 to each other. The second flow path is a flow path midway between the liquid outlet of indoor heat exchanger 2 and the heat source apparatus. Pipe 23 connects an outlet of the second flow path in second heat exchanger 3 and liquid outlet P22 of load apparatus 101 to each other.

Flow rate distribution valve 1A adjusts a ratio between flow rates at which the heating medium that flows from pipe 13 into branch portion P31 flows as being distributed to branch pipe 31 and branch pipe 32. FIGS. 3 to 6 are each a diagram showing a modification of the flow rate regulator. Though FIG. 2 shows the configuration where flow rate distribution valve 1A configured to change a distribution ratio is provided in branch portion P31 as the flow rate regulator, modifications as shown in FIGS. 3 to 6 may be made. For the sake of ease in view of the figures, controller 51 and temperature sensor 52 are not shown in FIG. 3 and figures that follow.

Figure 3:
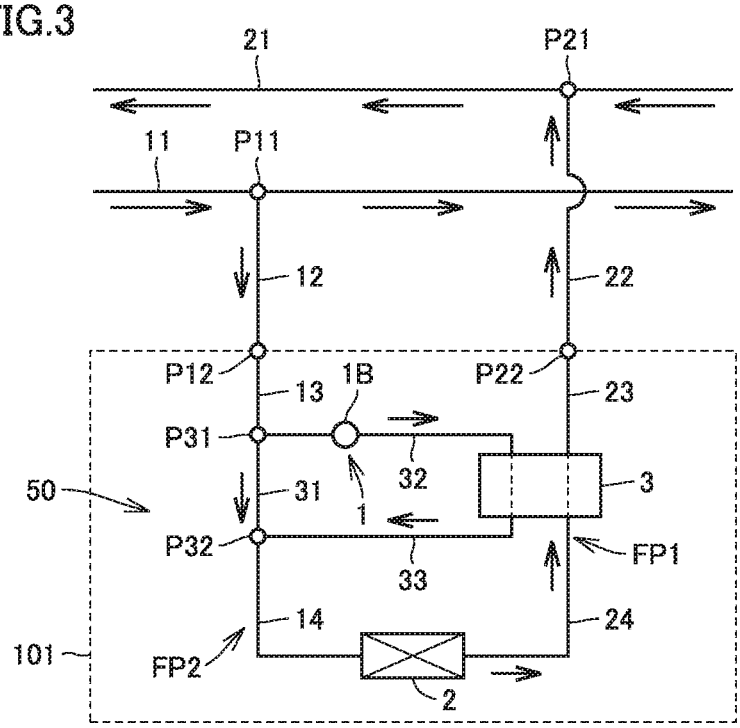
FIG. 3 is a diagram showing a first modification of a flow rate regulator.

In the example shown in FIG. 3, flow rate regulator 1 includes a flow rate regulation valve (a first flow rate regulation valve) 1B arranged in branch pipe 32. Flow rate regulation valve 1B may be provided in branch pipe 33. Flow rate regulation valve 1B changes a ratio between the flow rate of the heating medium that flows through branch pipes 32 and 33 and the flow rate of the heating medium that flows through branch pipe 31. An electric valve of which position can be adjustable can be employed for flow rate regulation valve 1B. When the flow rate through pipe 13 is constant, with decrease in opening of flow rate regulation valve 1B in pipe FP1, the flow rate of the heating medium that flows through branch pipes 32 and 33 is lowered and the flow rate of the heating medium that flows through branch pipe 31 increases. Flow rate regulation valve 1B may be arranged in branch pipe 31 instead of branch pipe 32 or 33.

Figure 4:
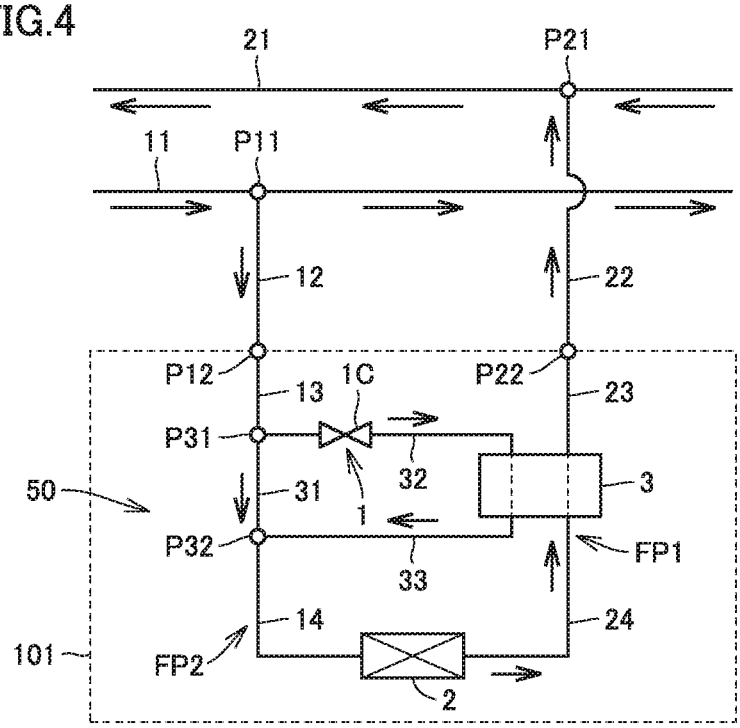
FIG. 4 is a diagram showing a second modification of the flow rate regulator.

In the example shown in FIG. 4, flow rate regulator 1 includes a cut-off valve 1C (a first cut-off valve) arranged in branch pipe 32 and configured to perform an intermittent operation. Cut-off valve 1C can perform an intermittent operation. Cut-off valve 1C may be provided in branch pipe 33. Cut-off valve 1C may be arranged in branch pipe 31 instead of pipe FP1. Controller 51 controls opening and closing of cut-off valve 1C to intermittently repeat ON and OFF. Controller 51 changes a ratio between the flow rate of the heating medium that flows through branch pipes 32 and 33 and the flow rate of the heating medium that flows through branch pipe 31 by changing an ON duty ratio of cut-off valve 1C.

Figure 5:
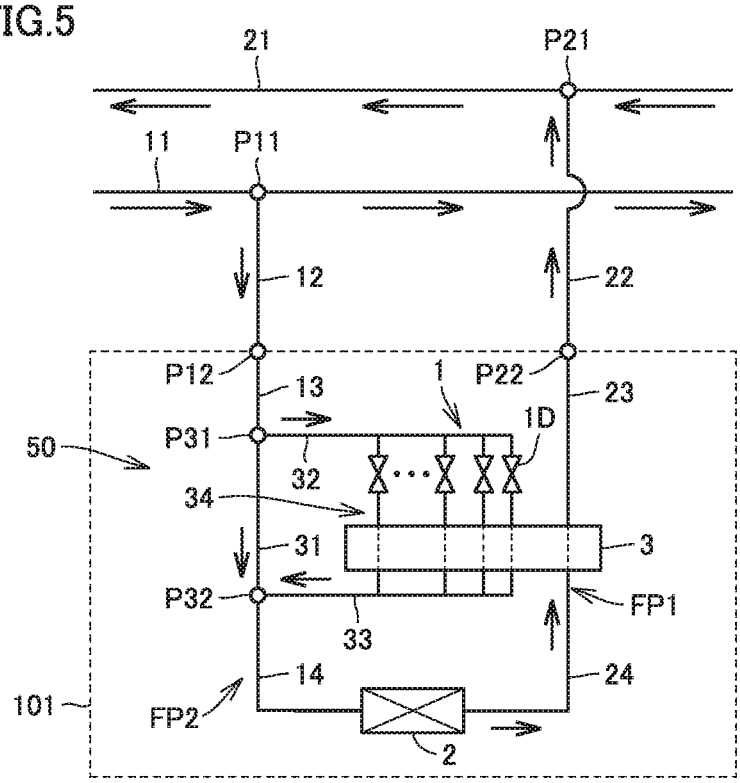
FIG. 5 is a diagram showing a third modification of the flow rate regulator.
Figure 6:
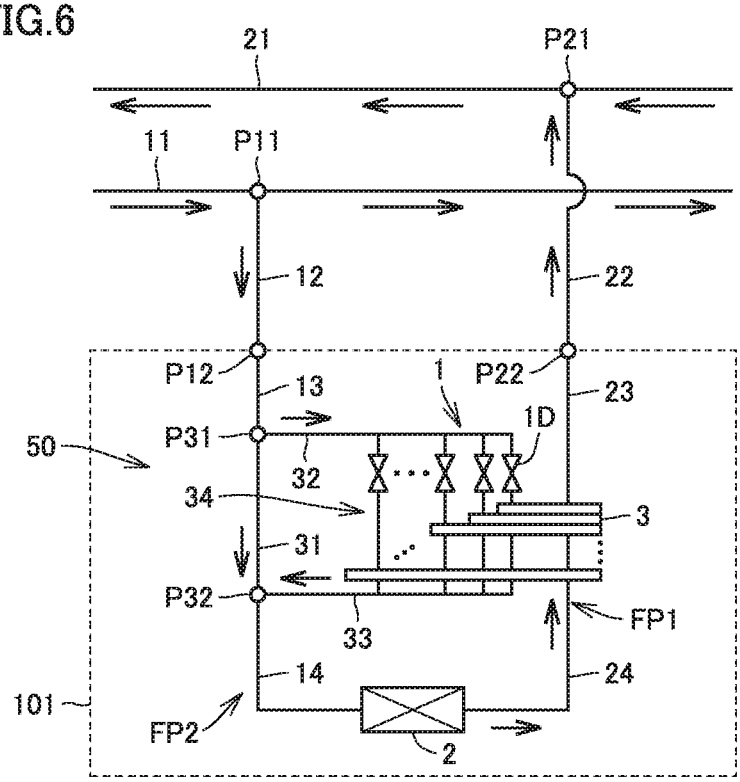
FIG. 6 is a diagram showing a fourth modification of the flow rate regulator.

In the examples shown in FIGS. 5 and 6, pipe FP2 (the second pipe) includes a plurality of branch pipes 34 (third branch pipes) arranged in parallel. The plurality of branch pipes 34 are structured to be branched off from branch pipe 32 (the first branch pipe) and to be merged with branch pipe 33 (the first branch pipe). The heating medium that flows through the plurality of branch pipes 34 exchanges heat with the heating medium that flows through pipe FP1 (the first pipe) in second heat exchanger 3. Flow rate regulator 1 includes a plurality of cut-off valves 1D provided in respective ones of the plurality of branch pipes 34.

In particular in the example shown in FIG. 6, second heat exchanger 3 is configured to be different in amount of heat exchange for each of the plurality of branch pipes 34.

Though flow rate regulator 1 in each of FIGS. 3 and 6 is shown as being provided on a side of branch pipe 32, it may be provided on a side of branch pipe 33.

A flow of the heating medium will be described with reference to FIGS. 1 and 2 again. An arrow shown in FIG. 2 indicates a direction of flow of the heating medium.

The heating medium delivered from pump WP flows through trunk pipe 11. Some of the heating medium that flows through trunk pipe 11 flows into liquid inlet P12 of load apparatus 101 via pipe 12 branched off in main branch portion P11.

The heating medium that flows from main branch portion P11 into pipe 12 flows through pipe 13 and reaches branch portion P31. The heating medium (cold water) that has reached branch portion P31 flows as being split into the heating medium to branch pipe 31 and the heating medium to branch pipe 32. The heating medium that flows through branch pipe 32 increases in temperature by exchanging in second heat exchanger 3, heat with the heating medium that flows through pipe FP1 downstream from indoor heat exchanger 2. The heating medium that has increased in temperature flows through branch pipe 33 and reaches merge portion P32. When the heating medium that flows through branch pipe 31 reaches merge portion P32, it is merged with the heating medium that flows through branch pipe 33. Consequently, the heating medium supplied through pipe 12 increases in temperature by being mixed with the heating medium that has increased in temperature in second heat exchanger 3.

The heating medium that has reached merge portion P32 flows through pipe 14 and flows into indoor heat exchanger 2. The heating medium that has flowed into indoor heat exchanger 2 exchanges heat with air and cools air in room R which is a space to be air-conditioned where load apparatus 101 is provided. The heating medium that has exchanged heat with air in indoor heat exchanger 2 increases in temperature, flows through pipe 24, and flows into second heat exchanger 3. The heating medium that has flowed into second heat exchanger 3 exchanges heat with the heating medium that flows through pipe FP2 on an upstream side and lowers in temperature. The heating medium that has lowered in temperature flows through pipe 23 and reaches liquid outlet P22 of load apparatus 101.

The heating medium that has reached liquid outlet P22 of load apparatus 101 flows out of load apparatus 101 and flows through pipe 22. The heating medium that flows through pipe 22 is merged in main merge portion P21 with the heating medium that flows through trunk pipe 21. The heating medium merged in trunk pipe 21 flows to heat source apparatus CS in FIG. 1 and is cooled again.

Figure 7:
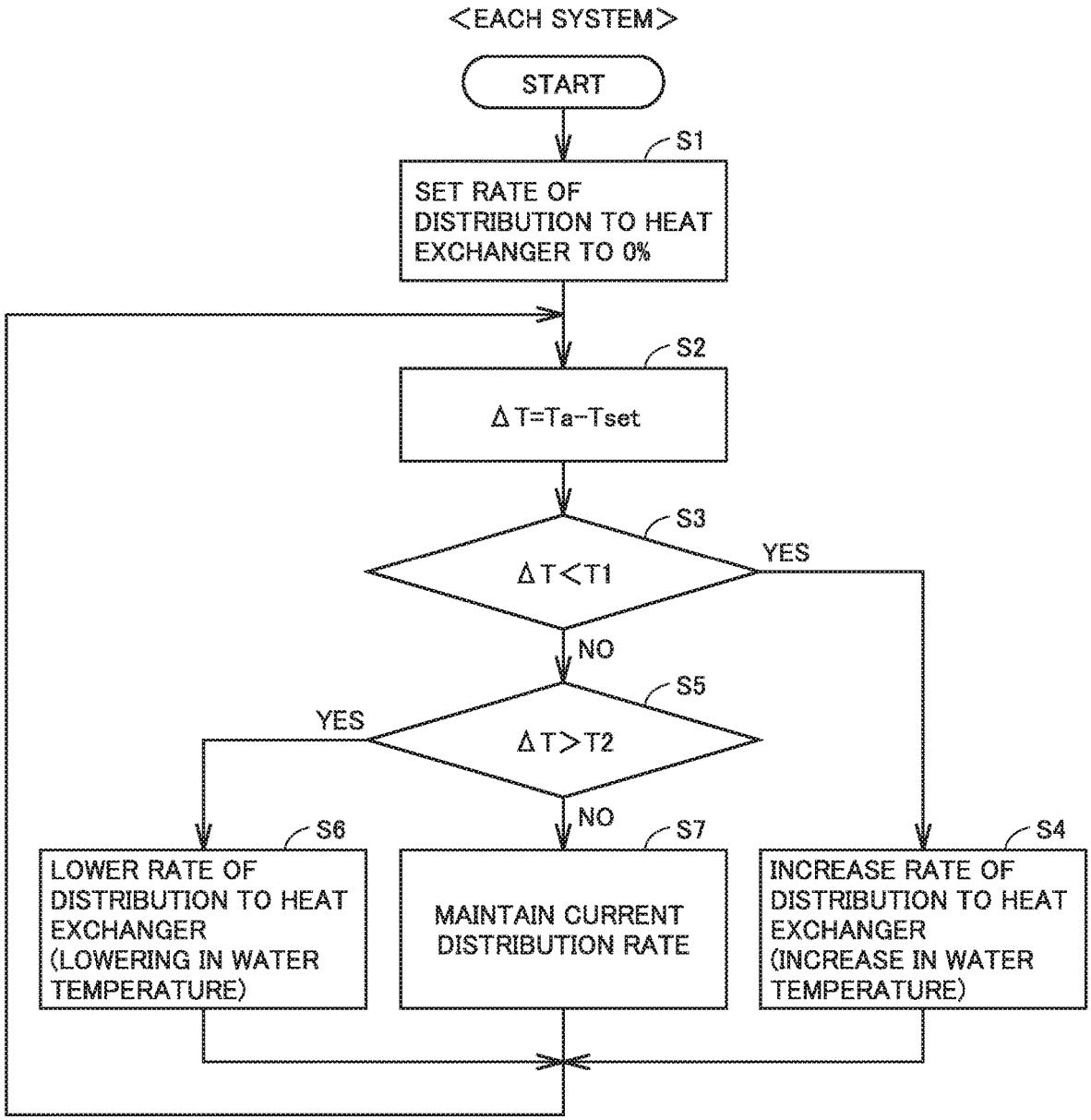
FIG. 7 is a flowchart showing control of the flow rate regulator by a controller.

FIG. 7 is a flowchart showing control of the flow rate regulation valve by the controller. Processing in the flowchart is started in response to an instruction to start an operation of an air-conditioning apparatus. Referring to FIGS. 2 and 7, initially in step S1, controller 51 controls flow rate distribution valve 1A such that a rate of distribution to a primary side passage in second heat exchanger 3 is set to 0%. Since the heating medium (cold water) from heat source apparatus CS thus entirely flows through branch pipe 31, it is supplied as it is to indoor heat exchanger 2. Thus, in initial setting, cooling capability of indoor heat exchanger 2 is set to the maximum.

Thereafter, when cooling capability of indoor heat exchanger 2 is too high relative to an air-conditioning load, controller 51 controls flow rate distribution valve 1A such that the flow rate of the heating medium introduced into second heat exchanger 3 increases and the flow rate of the heating medium that flows through branch pipe 31 is lowered. Then, a temperature at the inlet, of the heating medium that flows into indoor heat exchanger 2 increases and cooling capability of indoor heat exchanger 2 is lowered.

More specifically, initially in step S2, controller 51 calculates a temperature difference ΔT (=Ta−Tset) between a temperature of the room Ta and a set temperature Tset. Then, in step S3, controller 51 determines whether or not temperature difference ΔT is smaller than a criterion temperature T1. When a condition of ΔT<T1 is satisfied (YES in S3), in step S4, controller 51 controls flow rate distribution valve 1A such that the rate of distribution to second heat exchanger 3 is higher. A temperature of the heating medium supplied to indoor heat exchanger 2 thus increases.

When the condition of ΔT<T1 is not satisfied (NO in S3), controller 51 determines in step S5 whether or not temperature difference ΔT is larger than a criterion temperature T2. When a condition of ΔT>T2 is satisfied (YES in S5), in step S6, controller 51 controls flow rate distribution valve 1A such that the rate of distribution to second heat exchanger 3 is lowered. A temperature of the heating medium supplied to indoor heat exchanger 2 is thus lowered.

An upper limit of the distribution rate for increase in flow rate in processing in step S4 is 100% and a lower limit of the distribution rate for lowering in flow rate in the processing in step S6 is 0%.

When the condition of ΔT>T2 is not satisfied (NO in S5), in step S7, controller 51 controls flow rate distribution valve 1A such that the current distribution rate is maintained.

Figure 8:
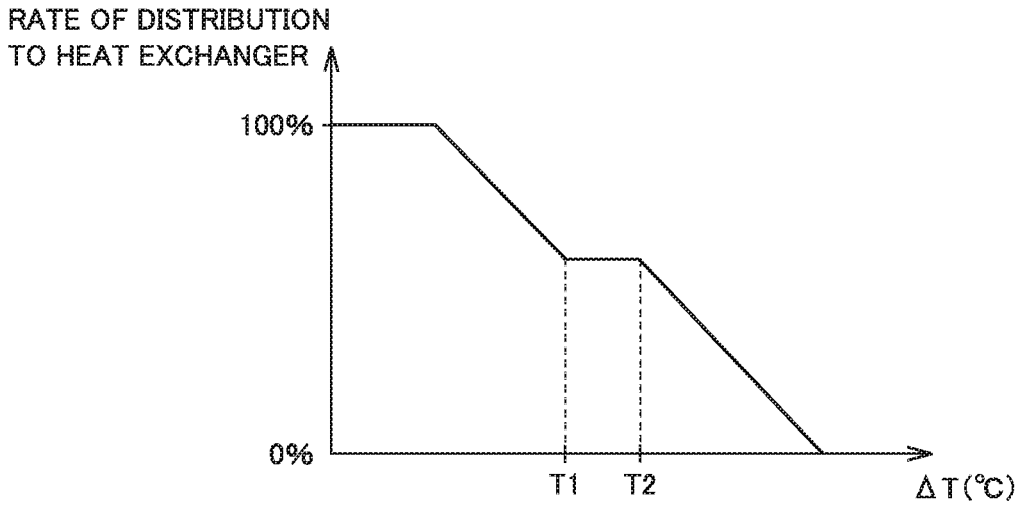
FIG. 8 is a graph showing relation between a rate of distribution to a second heat exchanger and a temperature difference ΔT.

When the distribution rate of flow rate distribution valve 1A is determined in the processing in any of steps S4, S6, and S7, the processing in S2 or later is again performed. When a command to stop the operation is issued during this period, the process ends, FIG. 8 is a graph showing relation between a rate of distribution to the second heat exchanger and temperature difference ΔT. As control in accordance with the flowchart in FIG. 7 is carried out, relation between the rate of distribution to the heat exchanger and temperature difference ΔT is as shown in FIG. 8. Criterion temperatures T1 and T2 are each set to an appropriate value depending on an air-conditioning load (an area or a capacity of a room). While a condition of T2≥T1 is satisfied and ΔT is between temperatures T1 and T2, the distribution rate is appropriate and the current distribution rate is maintained. Set temperature Tset in FIG. 1 is a temperature set by a user of the air-conditioning system.

As described above, the temperature adjustment apparatus and the load apparatus according to the first embodiment lower cooling capability of indoor heat exchanger 2 when an air-conditioning load is low, so that indoor heat exchanger 2 can continuously operate and user discomfort due to intermittent air blow is not caused. Since an excess latent heat load can be reduced by increasing a water temperature while the air-conditioning load is low, cooling capability can be lowered and an amount of electric power consumption of the heat source apparatus can be reduced.

When the temperature of the heating medium that flows into indoor heat exchanger 2 is higher than a temperature of the heating medium that flows through the trunk pipe (a water feed temperature) in all rooms, in addition to control of flow rate distribution valve 1A described with reference to the flowchart, heat source apparatus CS may be controlled to increase the water feed temperature. By increasing the temperature of the heating medium supplied from heat source apparatus CS, an evaporation temperature in a refrigeration cycle in heat source apparatus CS can be increased and hence electric power consumption of a compressor can be reduced.

The heating medium may be set to an appropriate temperature by lowering the flow rate of pump WP to increase a difference in temperature of the heating medium between the inlet and the outlet of heat source apparatus CS and then using the temperature adjustment apparatus in each indoor unit. In this case, motive power for delivery by the pump is lowered and hence electric power consumption of the pump can be reduced.

Second Embodiment

Figure 9:
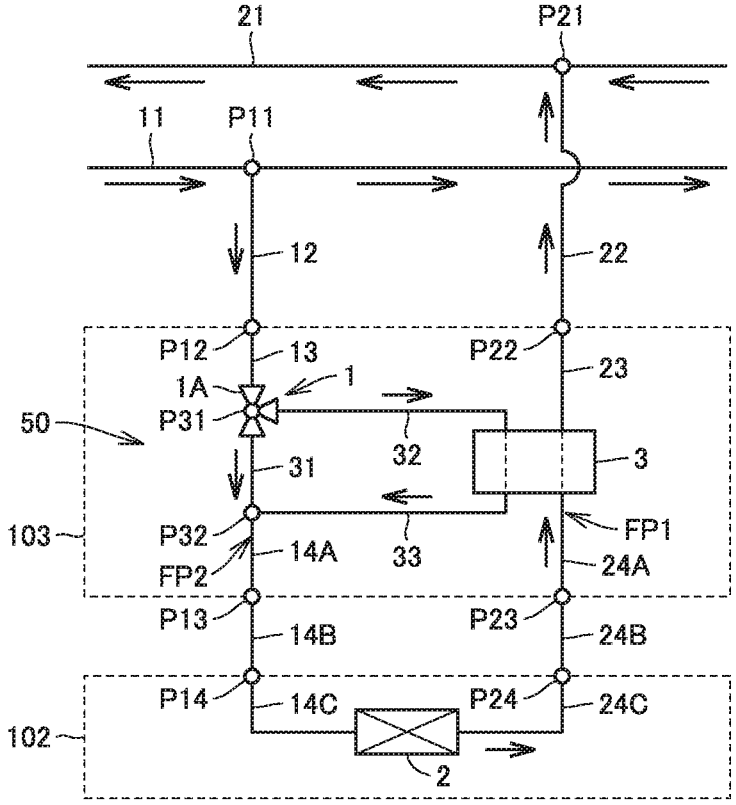
FIG. 9 is a diagram showing a circuit configuration of a load apparatus and an intermediary apparatus and a flow of a heating medium according to a second embodiment.

FIG. 9 is a diagram showing a circuit configuration of a load apparatus 102 and an intermediary apparatus 103 and a flow of a heating medium according to a second embodiment.

Air-conditioning system 1000 according to the second embodiment includes heat source apparatus CS, pump WP, a plurality of load apparatuses 102-1 to **102-*n*, a plurality of intermediary apparatuses 103-1 to 103-*n*, and a pipe, and temperature adjustment apparatus 50 accommodated in load apparatus 101 according to the first embodiment is accommodated in intermediary apparatus 103**.

Load apparatus 102 is connected to heat source apparatus CS with intermediary apparatus 103 being interposed, and load apparatus 102 and intermediary apparatus 103 are connected to each other through pipe 14 and pipe 24. Intermediary apparatus 103 is connected to trunk pipe 11 and trunk pipe 21 through connection pipe 12 and connection pipe 22. Load apparatus 102 includes indoor heat exchanger 2, a pipe 14C that connects a liquid inlet P14 of load apparatus 102 and indoor heat exchanger 2 to each other, a pipe 24C that connects indoor heat exchanger 2 and a liquid outlet P24 of load apparatus 102 to each other.

Intermediary apparatus 103 includes temperature adjustment apparatus 50. Intermediary apparatus 103 is arranged between trunk pipes 11 and 21 for the heating medium and indoor heat exchanger 2. Though temperature adjustment apparatus 50 is configured in the present embodiment as in FIG. 2, the temperature adjustment apparatus may include any of the configuration of the temperature adjustment apparatus shown in FIGS. 3 to 6 and a configuration of a temperature adjustment apparatus shown later in FIG. 13.

Temperature adjustment apparatus 50 includes pipe FP1 and pipe FP2 through which the heating medium flows, second heat exchanger 3, and flow rate regulator 1. Temperature adjustment apparatus 50 further includes the first path (FP1) from a liquid inlet P23 of intermediary apparatus 103 to liquid outlet P22 and the second path (FP2) from liquid inlet P12 of intermediary apparatus 103 to a liquid outlet P13. The first path includes a pipe 24A that connects liquid inlet P23 of intermediary apparatus 103 and second heat exchanger 3 to each other and pipe 23 that connects second heat exchanger 3 and liquid outlet P22 of intermediary apparatus 103 to each other.

The second path includes pipe 13 that connects liquid inlet P12 of intermediary apparatus 103 and branch portion P31 to each other, branch pipe 31 that connects branch portion P31 and merge portion P32 to each other, branch pipe 32 that connects branch portion P31 and second heat exchanger 3 to each other, branch pipe 33 that connects second heat exchanger 3 and merge portion P32 to each other, and a pipe 14A that connects merge portion P32 and liquid outlet P13 of intermediary apparatus 103 to each other.

Flow rate regulator 1 includes flow rate distribution valve 1A configured to regulate the flow rate at which the heating medium that flows from pipe 13 into branch portion P31 flows as being split into the heating medium to branch pipe 31 and the heating medium to branch pipe 32. Though FIG. 9 shows such a configuration that flow rate regulator 1 includes flow rate distribution valve 1A in branch portion P31, modification as shown in FIGS. 3 to 6 may be made. Though flow rate regulator 1 in FIGS. 9 and 3 to 6 is shown as being provided on the side of branch pipe 32, it may be provided on the side of branch pipe 33.

Temperature adjustment apparatus 50 is connected to a side of the heat source apparatus at two locations of liquid inlet P12 and liquid outlet P22 of intermediary apparatus 103. Liquid inlet P12 of intermediary apparatus 103 is connected to pipe 12 branched off in main branch portion P11 from trunk pipe 11 through which the heating medium for the air-conditioning system flows. Liquid outlet P22 of intermediary apparatus 103 is connected to pipe 22 merged in main merge portion P21 with trunk pipe 21 through which the heating medium for the air-conditioning system flows.

Load apparatus 102 is connected to intermediary apparatus 103 at two locations of liquid inlet P14 and liquid outlet P24 of load apparatus 102. Liquid inlet P14 of load apparatus 102 is connected to liquid outlet P13 of intermediary apparatus 103 through pipe 14B. Liquid outlet P24 of load apparatus 102 is connected to liquid inlet P23 of intermediary apparatus 103 through pipe 24B.

A flow of the heating medium will be described with reference to FIG. 9. An arrow shown in FIG. 9 indicates a direction of flow of the heating medium. The heating medium delivered from pump WP in FIG. 1 flows through trunk pipe 11. Some of the heating medium that flows through trunk pipe 11 flows into intermediary apparatus 103 from liquid inlet P12 of intermediary apparatus 103 via pipe 12 branched off in main branch portion P11.

The heating medium that flows in from liquid inlet P12 of intermediary apparatus 103 flows through pipe 13 and reaches branch portion P31. The heating medium (cold water) that has reached branch portion P31 flows as being split into the heating medium to branch pipe 31 and the heating medium to branch pipe 32. The heating medium that flows through branch pipe 32 increases in temperature by exchanging in second heat exchanger 3, heat with the heating medium that flows through pipe FP1 downstream from indoor heat exchanger 2. The heating medium that has increased in temperature flows through branch pipe 33 and reaches merge portion P32. When the heating medium that flows through branch pipe 31 reaches merge portion P32, it increases in temperature by being mixed with the heating medium that flows through branch pipe 33. The heating medium that has reached merge portion P32 flows through pipe 14A and reaches liquid outlet P13 of intermediary apparatus 103. The heating medium that has reached liquid outlet P13 of intermediary apparatus 103 flows out of intermediary apparatus 103 and flows through pipe 14B. The heating medium that flows through pipe 14B flows into load apparatus 102 from liquid inlet P14 of load apparatus 102.

The heating medium that has flowed into load apparatus 102 flows through pipe 14C and flows into indoor heat exchanger 2. The heating medium that has flowed into indoor heat exchanger 2 exchanges heat with air and cools the space to be air-conditioned. The heating medium that has exchanged heat with air in indoor heat exchanger 2 increases in temperature, flows through pipe 24C, and reaches liquid outlet P24 of load apparatus 102. The heating medium that has reached liquid outlet P24 of load apparatus 102 flows out of load apparatus 102 and flows through pipe 24B. The heating medium that flows through pipe 24B reaches liquid inlet P23 of intermediary apparatus 103. Refrigerant that has reached liquid inlet P23 of intermediary apparatus 103 flows through pipe 24A and flows into second heat exchanger 3. The heating medium that has flowed into second heat exchanger 3 lowers in temperature by exchanging heat with the heating medium that flows through pipe FP2 on the upstream side. The heating medium that has lowered in temperature flows through pipe 23 and reaches liquid outlet P22 of intermediary apparatus 103.

The heating medium that has reached liquid outlet P22 of intermediary apparatus 103 flows out of intermediary apparatus 103 and flows through pipe 22. The heating medium that flows through pipe 22 is merged in main merge portion P21 with the heating medium that flows through trunk pipe 21. The heating medium merged in trunk pipe 21 flows to heat source apparatus CS in FIG. 1 and is cooled again.

The second embodiment shown in FIG. 9 from which intermediary apparatus 103 is removed is identical in configuration to a general air-conditioning system. In other words, the second embodiment is such that intermediary apparatus 103 is connected between pipe 12 and liquid inlet P14 of load apparatus 102 and between pipe 22 and liquid outlet P24 of load apparatus 102 in a general air-conditioning system. In a building in which an air-conditioning system has already been introduced as well, by detaching load apparatus 102 from pipe 12 and pipe 22 and introducing intermediary apparatus 103, energy saving performance of the existing air-conditioning system can readily be improved.

Figure 10:
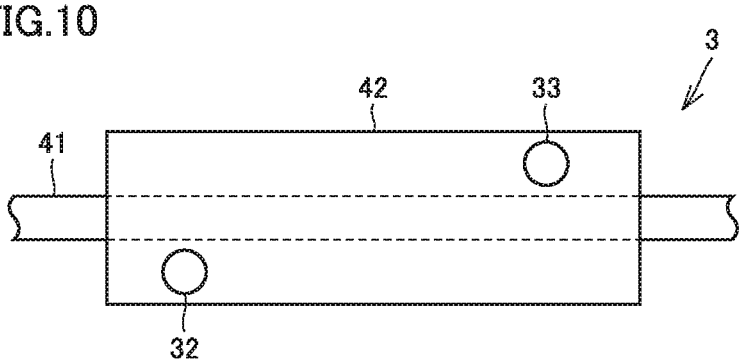
FIG. 10 is a front view of an exemplary configuration of a second heat exchanger 3.
Figure 11:
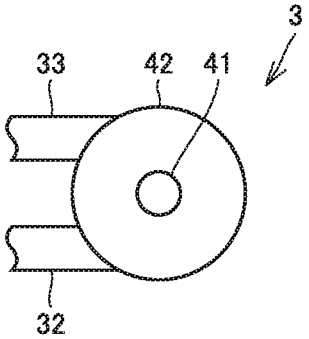
FIG. 11 is a side view of the exemplary configuration of second heat exchanger 3.
Figure 12:
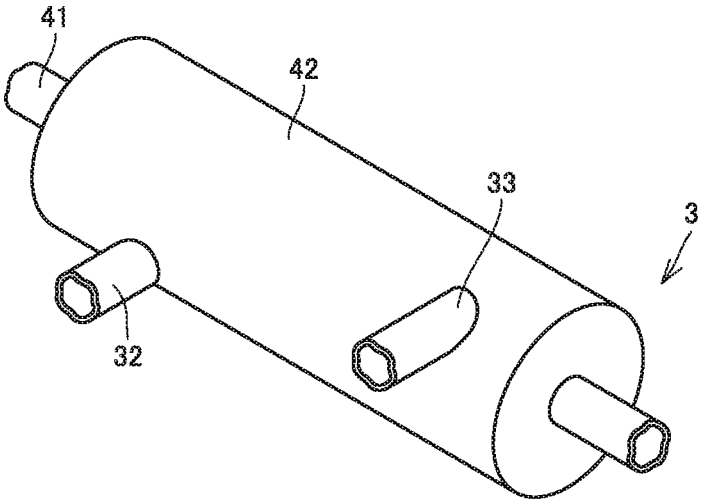
FIG. 12 is a perspective view of the exemplary configuration of second heat exchanger 3.

An exemplary configuration of second heat exchanger 3 preferred for readily introducing a function of adjustment of a temperature of the heating medium into an existing air-conditioning system will further be described. FIG. 10 is a front view of an exemplary configuration of second heat exchanger 3. FIG. 11 is a side view of the exemplary configuration of second heat exchanger 3. FIG. 12 is a perspective view of the exemplary configuration of second heat exchanger 3.

In FIGS. 10 to 12, one of components of second heat exchanger 3 is an existing pipe 41. A cylindrical component 42 having an inner diameter larger in diameter than existing pipe 41 is provided to cover existing pipe 41 around the same. A pipe connection portion is provided in a side surface of component 42, to which branch pipes 32 and 33 in FIG. 9 can be connected. By dividing cylindrical component 42, arranging the divided components to cover pipe 41 around the same, and thereafter integrating the components together, the inside and the outside of the existing pipe are filled with the heating medium and heat can be exchanged. Since one of heat exchangers can be used with its existing state being maintained, introduction to an existing air-conditioning system can further be facilitated.

Third Embodiment

Figure 13:
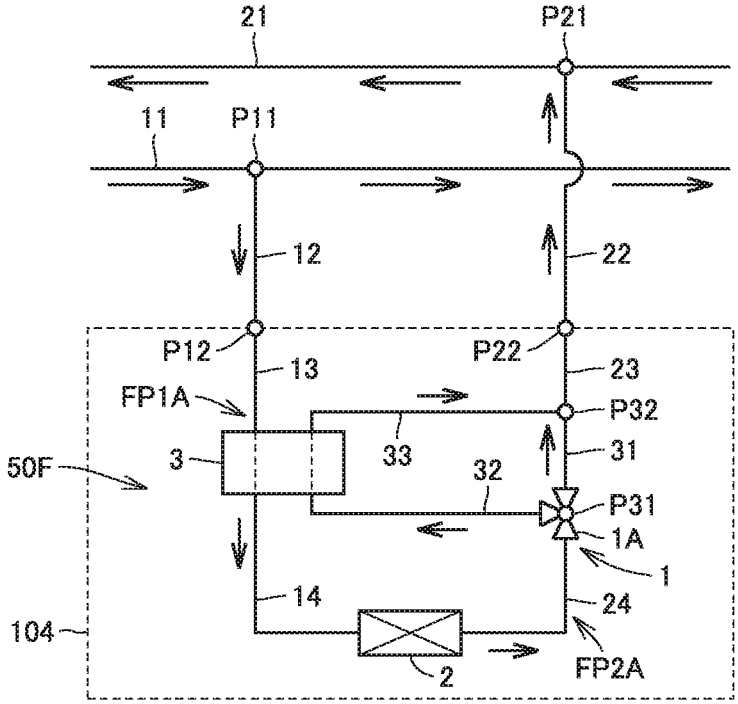
FIG. 13 is a diagram showing a circuit configuration of a load apparatus and a flow of a heating medium according to a third embodiment.

FIG. 13 is a diagram showing a circuit configuration of a load apparatus and a flow of a heating medium according to a third embodiment. Referring to FIG. 13, a load apparatus 104 includes a temperature adjustment apparatus 50F and indoor heat exchanger 2. Temperature adjustment apparatus 50F includes a pipe FP1A and a pipe FP2A through which the heating medium flows, flow rate regulator 1, and second heat exchanger 3. Pipe FP2A is configured to be branched into first branch pipe 32 and second branch pipe 31, the first branch pipe and the second branch pipe thereafter being merged again. Flow rate regulator 1 includes flow rate distribution valve 1A. Pipe FP2A includes pipes 23 and 24 and branch pipes 31, 32, and 33. Pipe FP1A includes pipes 13 and 14. Though not shown, controller 51 and temperature sensor 52 are also arranged as in FIG. 2.

Pipe 13 guides the heating medium from liquid inlet P12 of load apparatus 104 to second heat exchanger 3. Pipe 14 connects second heat exchanger 3 and indoor heat exchanger 2 to each other. Pipe 24 connects indoor heat exchanger 2 and branch portion P31 to each other. Branch pipe 31 serves as a main circuit that connects branch portion P31 and merge portion P32 to each other. Branch pipe 32 connects branch portion P31 and second heat exchanger 3 to each other. Branch pipe 33 connects second heat exchanger 3 and merge portion P32 to each other. Pipe 23 connects merge portion P32 and liquid outlet P22 of load apparatus 104 to each other.

Flow rate regulator 1 includes flow rate distribution valve 1A configured to regulate the flow rate at which the heating medium that flows from pipe 24 into branch portion P31 flows as being distributed to branch pipe 31 and branch pipe 32. Though FIG. 13 shows such a configuration that flow rate distribution valve 1A is provided in branch portion P31, modification as in the examples in FIGS. 3 to 6 may be made. Though the flow rate regulator in each of FIGS. 3 to 6 is shown as being provided in branch pipe 32, it may be provided in branch pipe 33.

Load apparatus 104 is connected to trunk pipes 11 and 21 extending from the heat source apparatus, at two locations of liquid inlet P12 and liquid outlet P22 of load apparatus 104. Liquid inlet P12 of load apparatus 104 is connected to pipe 12 branched off in main branch portion P11 from trunk pipe 11 through which the heating medium for the air-conditioning system flows. Liquid outlet P22 of load apparatus 104 is connected to pipe 22 merged in main merge portion P21 with trunk pipe 21 through which the heating medium for the air-conditioning system flows.

A flow of the heating medium will be described with reference to FIG. 13. An arrow shown in FIG. 13 indicates a direction of flow of the heating medium. The heating medium delivered from pump WP in FIG. 1 flows through trunk pipe 11. Some of the heating medium that flows through trunk pipe 11 flows into load apparatus 104 from liquid inlet P12 of load apparatus 104 via pipe 12 branched off in main branch portion P11.

The heating medium (cold water) that has flowed from liquid inlet P12 of load apparatus 104 flows through pipe 13 and flows into second heat exchanger 3, and increases in temperature by exchanging heat with the heating medium that flows through pipe FP2A downstream from indoor heat exchanger 2. The heating medium that has increased in temperature flows through pipe 14 and flows into indoor heat exchanger 2. The heating medium that has flowed into indoor heat exchanger 2 exchanges heat with air and cools the space to be air-conditioned. The heating medium that has exchanged heat with air in indoor heat exchanger 2 increases in temperature and reaches branch portion P31. The heating medium that has reached branch portion P31 is branched and flows through branch pipe 31 and branch pipe 32. The heating medium that flows through branch pipe 32 lowers in temperature by exchanging heat with the heating medium that flows through pipe FP1A on the upstream side in second heat exchanger 3. The heating medium that has lowered in temperature flows through branch pipe 33 and reaches merge portion P32. The heating medium that flows through branch pipe 31 reaches merge portion P32 and lowers in temperature by being mixed with the heating medium that flows through branch pipe 33. The heating medium that has reached merge portion P32 flows through pipe 23 and reaches liquid outlet P22 of load apparatus 104.

The heating medium that has reached liquid outlet P22 of load apparatus 104 flows out of load apparatus 104 and flows through pipe 22. The heating medium that flows through pipe 22 is merged in main merge portion P21 with the heating medium that flows through trunk pipe 21. The heating medium merged in trunk pipe 21 flows to heat source apparatus CS in FIG. 1 and is cooled again.

As described above, by providing a flow path for bypassing second heat exchanger 3 on the side downstream from indoor heat exchanger 2 as in the third embodiment as well, the temperature of the heating medium supplied to indoor heat exchanger 2 can be adjusted as in the configuration in FIG. 2.

Fourth Embodiment

Figure 14:
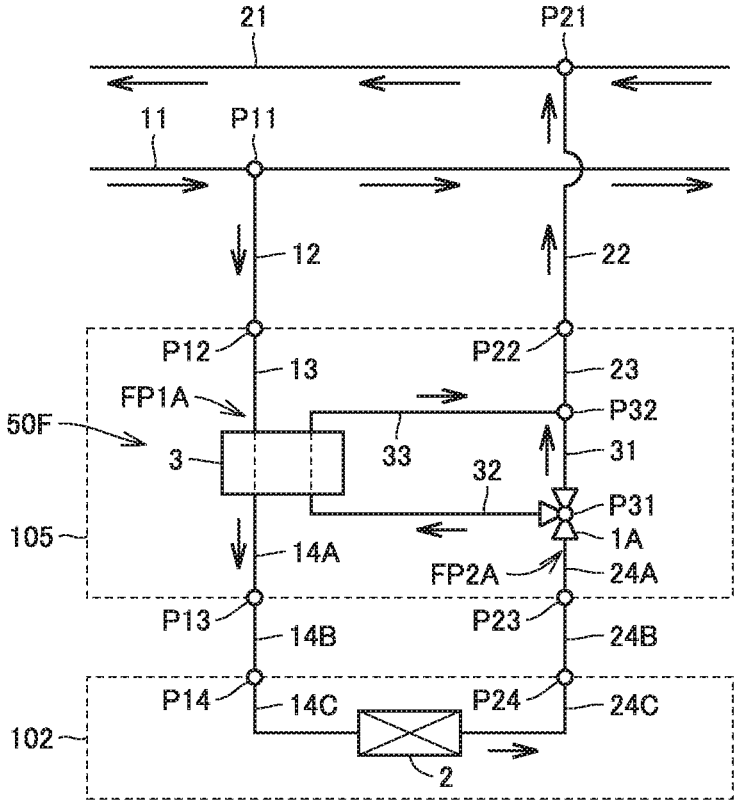
FIG. 14 is a diagram showing a circuit configuration of the load apparatus and an intermediary apparatus and a flow of a heating medium according to a fourth embodiment.

FIG. 14 is a diagram showing a circuit configuration of load apparatus 102 and an intermediary apparatus 105 and a flow of a heating medium according to a fourth embodiment.

The fourth embodiment is such that components included in load apparatus 104 according to the third embodiment are accommodated in load apparatus 102 and intermediary apparatus 105 as being grouped. Since load apparatus 102 is similar in configuration to the second and third embodiments, description will not be repeated.

Intermediary apparatus 105 includes temperature adjustment apparatus 50F. Intermediary apparatus 105 is arranged between trunk pipes 11 and 21 for the heating medium and indoor heat exchanger 2.

Temperature adjustment apparatus 50F includes pipe FP1A and pipe FP2A through which the heating medium flows, second heat exchanger 3, and flow rate regulator 1. Temperature adjustment apparatus 50F further includes the first path (FP1A) from liquid inlet P12 to liquid outlet P13 of intermediary apparatus 105 and the second path (FP2A) from liquid inlet P23 to liquid outlet P22 of intermediary apparatus 105. The first path (FP1A) includes pipe 13 that connects liquid inlet P12 of intermediary apparatus 105 and second heat exchanger 3 to each other and pipe 14A that connects second heat exchanger 3 and liquid outlet P13 of intermediary apparatus 105 to each other. The second path (FP2A) includes pipe 24A that connects liquid inlet P23 of intermediary apparatus 105 and branch portion P31 to each other, branch pipe 31 that connects branch portion P31 and merge portion P32 to each other, branch pipe 32 that connects branch portion P31 and second heat exchanger 3 to each other, branch pipe 33 that connects second heat exchanger 3 and merge portion P32 to each other, and pipe 23 that connects merge portion P32 and liquid outlet P22 of intermediary apparatus 105 to each other.

Intermediary apparatus 105 includes flow rate distribution valve 1A configured to regulate the flow rate at which the heating medium that flows from pipe 24A into branch portion P31 flows as being split into the heating medium to branch pipe 31 and the heating medium to branch pipe 32. Though FIG. 14 shows such a configuration that flow rate distribution valve 1A is provided in branch portion P31, modification as shown in FIGS. 3 to 6 may be made. Though the flow rate regulator in each of FIGS. 3 to 6 is shown as being provided on the side of branch pipe 32, it may be provided on the side of branch pipe 33.

Intermediary apparatus 105 is connected to the side of the heat source apparatus at two locations of liquid inlet P12 and liquid outlet P22 of intermediary apparatus 105. Liquid inlet P12 of intermediary apparatus 105 is connected to pipe 12 branched off in main branch portion P11 from trunk pipe 11 through which the heating medium for the air-conditioning system flows. Liquid outlet P22 of intermediary apparatus 105 is connected to pipe 22 merged in main merge portion P21 with trunk pipe 21 through which the heating medium for the air-conditioning system flows.

Load apparatus 102 is connected to intermediary apparatus 105 at two locations of liquid inlet P14 and liquid outlet P24 of load apparatus 102. Liquid inlet P14 of load apparatus 102 is connected to liquid outlet P13 of intermediary apparatus 105 through pipe 14B. Liquid outlet P24 of load apparatus 102 is connected to liquid inlet P23 of intermediary apparatus 105 through pipe 24B.

A flow of the heating medium will be described with reference to FIG. 14. An arrow shown in FIG. 14 indicates a direction of flow of the heating medium. The heating medium delivered from pump WP in FIG. 1 flows through trunk pipe 11. Some of the heating medium that flows through trunk pipe 11 is branched in main branch portion P11 and flows into intermediary apparatus 105 from liquid inlet P12 of intermediary apparatus 105 through pipe 12.

The heating medium (cold water) that has flowed from liquid inlet P12 of intermediary apparatus 105 flows through pipe 13 and flows into second heat exchanger 3, and increases in temperature by exchanging heat with the heating medium that flows through pipe FP2A downstream from indoor heat exchanger 2. The heating medium that has increased in temperature flows through pipe 14A and reaches liquid outlet P13 of intermediary apparatus 105. The heating medium that has reached liquid outlet P13 of intermediary apparatus 105 flows out of intermediary apparatus 105 and flows through pipe 14B.

The heating medium that flows through pipe 14B flows from liquid inlet P14 of load apparatus 102 into load apparatus 102. The heating medium that has flowed into load apparatus 102 flows through pipe 14C and flows into indoor heat exchanger 2. The heating medium that has flowed into indoor heat exchanger 2 exchanges heat with air and cools the space to be air-conditioned. The heating medium that has exchanged heat with air in indoor heat exchanger 2 increases in temperature, flows through pipe 24C, and reaches liquid outlet P24 of load apparatus 102. The heating medium that has reached liquid outlet P24 of load apparatus 102 flows out of load apparatus 102 and flows through pipe 24B. The heating medium that flows through pipe 24B reaches liquid inlet P23 of intermediary apparatus 105.

The heating medium that has reached liquid inlet P23 of intermediary apparatus 105 flows through pipe 24A and reaches branch portion P31. The heating medium that has reached branch portion P31 is branched and flows through branch pipe 31 and branch pipe 32. The heating medium that flows through branch pipe 32 lowers in temperature by exchanging in second heat exchanger 3, heat with the heating medium that flows through pipe FP1A upstream from indoor heat exchanger 2. The heating medium that has lowered in temperature flows through branch pipe 33 and reaches merge portion P32. The heating medium that flows through branch pipe 31 reaches merge portion. P32 and lowers in temperature by being mixed with the heating medium that flows through branch pipe 33. The heating medium that has reached merge portion P32 flows through pipe 23 and reaches liquid outlet P22 of intermediary apparatus 105.

The heating medium that has reached liquid outlet P22 of intermediary apparatus 105 flows out of intermediary apparatus 105 and flows through pipe 22. The heating medium that flows through pipe 22 is merged in main merge portion P21 with the heating medium that flows through trunk pipe 21. The heating medium merged in trunk pipe 21 flows to heat source apparatus CS in FIG. 1 and is cooled again.

By adding intermediary apparatus 105 to an already provided air-conditioning system also in the fourth embodiment, a temperature of the heating medium to be supplied to indoor heat exchanger 2 can be changed.

Fifth Embodiment

Figure 15:
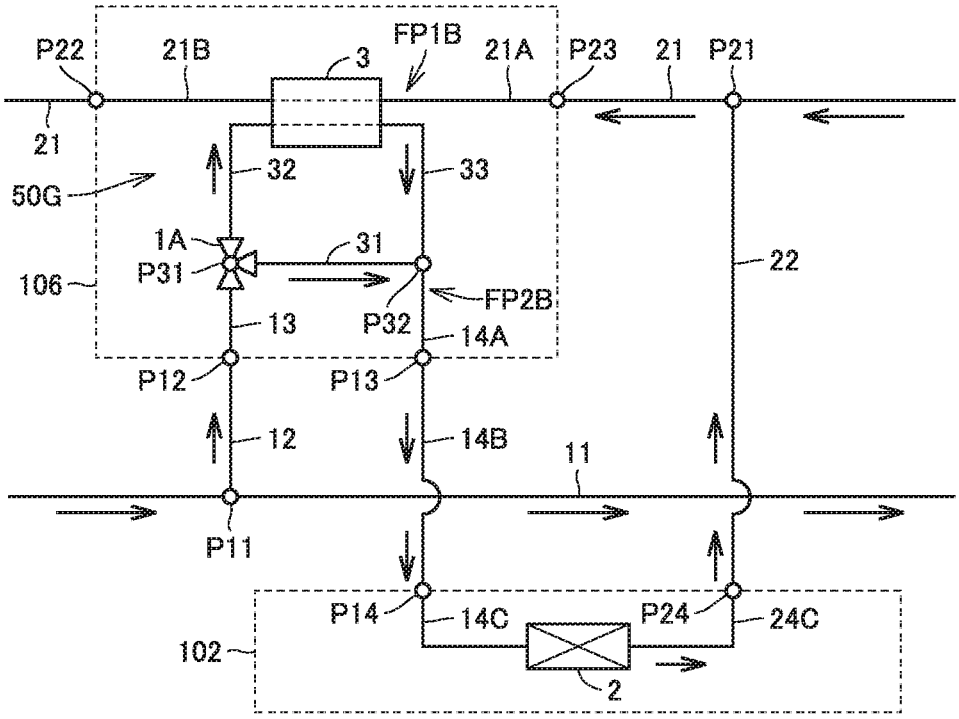
FIG. 15 is a diagram showing a circuit configuration of the load apparatus and an intermediary apparatus and a flow of a heating medium according to a fifth embodiment.

FIG. 15 is a diagram showing a circuit configuration of load apparatus 102 and an intermediary apparatus 106 and a flow of a heating medium according to a fifth embodiment. As shown in FIG. 1, the heating medium is supplied from heat source apparatus CS to the plurality of load apparatuses 101-1 to **101-*n* through trunk pipe 11 and returned to heat source apparatus CS through trunk pipe 21. Any one of load apparatuses 101-1 to 101-*n* falls under indoor heat exchanger 2 and others fall under load apparatuses configured to perform cooling by using the heating medium. In the example shown in FIG. 15, a pipe FP1B and a pipe FP2B in intermediary apparatus 106 correspond to pipe FP1 and pipe FP2 of intermediary apparatus 103 in the second embodiment shown in FIG. 9, respectively. Pipe FP1B is a part of trunk pipe 21 and pipe FP2B defines a flow path branched off from trunk pipe 11 for supply of the heating medium to indoor heat exchanger 2. Pipe FP2B may be a part of trunk pipe 11 and pipe FP1B may be a part of pipe 22 for return of the heating medium from indoor heat exchanger 2 to trunk pipe 21. Since load apparatus 102** is identical in configuration to the second embodiment, description will not be repeated.

Intermediary apparatus 106 includes a temperature adjustment apparatus 50G. Temperature adjustment apparatus 50G includes pipe FP1B and pipe FP2B through Which the heating medium flows, second heat exchanger 3, and flow rate regulator 1.

Temperature adjustment apparatus 50G further includes the first path (FP1B) from liquid inlet P23 to liquid outlet P22 of intermediary apparatus 106 and the second path (FP2B) from liquid inlet P12 to liquid outlet P13 of intermediary apparatus 106. The second path (FP2B) includes pipe 13 that connects liquid inlet P12 of intermediary apparatus 106 and branch portion P31 to each other, branch pipe 31 that connects branch portion P31 and merge portion P32 to each other, branch pipe 32 that connects branch portion P31 and second heat exchanger 3 to each other, branch pipe 33 that connects second heat exchanger 3 and merge portion P32 to each other, and pipe 14A that connects merge portion P32 and liquid outlet P13 of intermediary apparatus 106 to each other. The first path (FP1B) includes a trunk pipe 21A that connects liquid inlet P23 of intermediary apparatus 106 and second heat exchanger 3 to each other and a trunk pipe 21B that connects second heat exchanger 3 and liquid outlet P22 of intermediary apparatus 106 to each other.

Flow rate distribution valve 1A is configured to regulate the flow rate at which the heating medium that flows from pipe 13 into branch portion P31 flows as being split into the heating medium to branch pipe 31 and the heating medium to branch pipe 32. Though FIG. 15 shows such a configuration that flow rate distribution valve 1A is provided in branch portion P31, modification as shown in FIGS. 3 to 6 may be made. Though the flow rate regulator in each of FIGS. 3 to 6 is shown as being provided on the side of branch pipe 32, it may be provided on the side of branch pipe 33.

Intermediary apparatus 106 is connected to the trunk pipe for the heating medium for the air-conditioning system at three locations of liquid inlet P12, liquid inlet P23, and liquid outlet P22 of intermediary apparatus 106. Liquid inlet P12 of intermediary apparatus 106 is connected to pipe 12 branched off in main branch portion P11 from trunk pipe 11 through which the heating medium for the air-conditioning system flows. Intermediary apparatus 106 is inserted at an intermediate point of trunk pipe 21. Specifically, liquid inlet P23 of intermediary apparatus 106 is connected to an upstream side of trunk pipe 21 and liquid outlet P22 of intermediary apparatus 106 is connected to a downstream side of trunk pipe 21.

Liquid inlet P14 of load apparatus 102 is connected to liquid outlet P13 of intermediary apparatus 106 through pipe 14B. Liquid outlet P24 of load apparatus 102 is connected to main merge portion P21 of trunk pipe 21 through pipe 22.

A flow of the heating medium will be described with reference to FIG. 15, Δn arrow shown in FIG. 15 indicates a direction of flow of the heating medium. The heating medium delivered from pump WP in FIG. 1 flows through trunk pipe 11. Some of the heating medium that flows through trunk pipe 11 flows into intermediary apparatus 106 from liquid inlet P12 of intermediary apparatus 106 via pipe 12 branched off in main branch portion P11.

The heating medium that has flowed from liquid inlet P12 of intermediary apparatus 106 flows through pipe 13 and reaches branch portion P31. Some of the heating medium that has reached branch portion P31 flows through branch pipe 31 and the remainder flows through branch pipe 32. The heating medium that flows through branch pipe 32 increases in temperature by exchanging heat with the heating medium on a side of trunk pipe 21 in second heat exchanger 3. The heating medium that has increased in temperature flows through branch pipe 33 and reaches merge portion P32. The heating medium that flows through branch pipe 31 reaches merge portion P32 and increases in temperature by being mixed with the heating medium that flows through branch pipe 33. The heating medium merged in merge portion P32 flows through pipe 14A and reaches liquid outlet P13 of intermediary apparatus 106. The heating medium that has reached liquid outlet P13 of intermediary apparatus 106 flows out of intermediary apparatus 106 and flows through pipe 14B.

The heating medium that flows through pipe 14B flows into load apparatus 102 from liquid inlet P14 of load apparatus 102. The heating medium that has flowed in flows through pipe 14C and flows into indoor heat exchanger 2. The heating medium that has flowed into indoor heat exchanger 2 exchanges heat with air and cools the space to be air-conditioned. The heating medium that has exchanged heat with air in indoor heat exchanger 2 increases in temperature, flows through pipe 24C, and reaches liquid outlet P24 of load apparatus 102. The heating medium that has reached liquid outlet P24 of load apparatus 102 flows out of load apparatus 102 and flows through pipe 22.

The heating medium that flows through pipe 22 is merged in main merge portion P21 with the heating medium that flows through trunk pipe 21. The merged heating medium flows through a main exit pipe and reaches liquid inlet P23 of intermediary apparatus 106. Refrigerant that has reached liquid inlet P23 of intermediary apparatus 106 flows through pipe 21A and flows into second heat exchanger 3. The heating medium that has flowed into second heat exchanger 3 lowers in temperature by exchanging heat with the heating medium in branch pipes 32 and 33. The heating medium that has lowered in temperature flows through pipe 21B and reaches liquid outlet P22 of intermediary apparatus 106.

The heating medium that has reached liquid outlet P22 of intermediary apparatus 106 flows through trunk pipe 21, flows to heat source apparatus CS in FIG. 1, and is cooled again.

As shown in the fifth embodiment, energy saving performance of an existing air-conditioning system can be improved also by inserting the intermediary apparatus in the trunk pipe.

Sixth Embodiment

Figure 16:
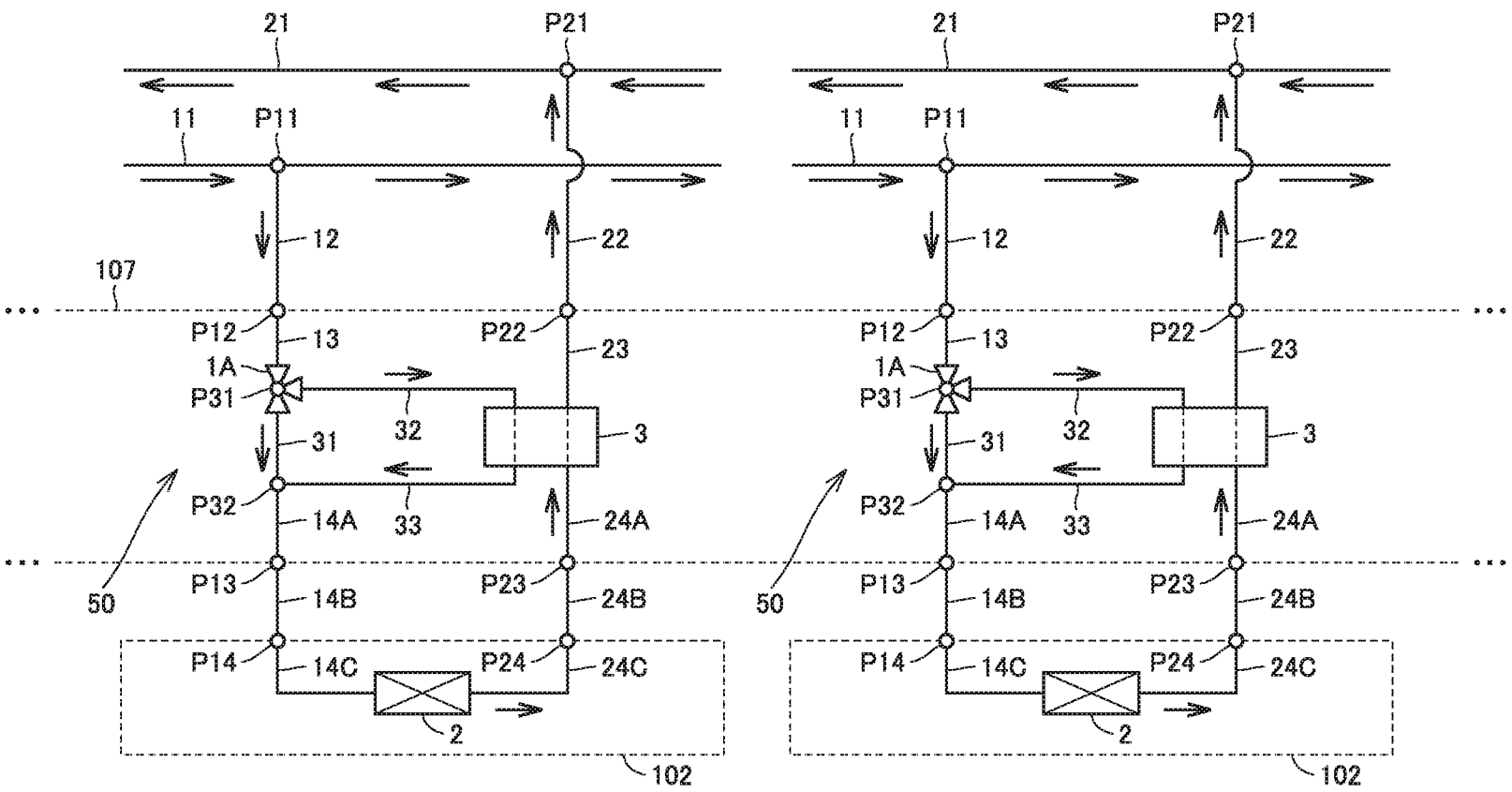
FIG. 16 is a diagram showing a circuit configuration of the load apparatus and an intermediary apparatus and a flow of a heating medium according to a sixth embodiment.

FIG. 16 is a diagram showing a circuit configuration of load apparatus 102 and an intermediary apparatus 107 and a flow of a heating medium according to a sixth embodiment.

In the sixth embodiment, when the air-conditioning system includes a plurality of load apparatuses 102, intermediary apparatus 107 interposed between the trunk pipe and the plurality of load apparatuses is employed. Intermediary apparatus 107 is an integrated version of intermediary apparatuses 103 according to the second embodiment.

As shown in FIG. 1, the heating medium is supplied from heat source apparatus CS to the plurality of indoor heat exchangers 2 through the trunk pipe. In the example shown in FIG. 16, intermediary apparatus 107 is arranged between trunk pipes 11 and 21 for the heating medium and the plurality of indoor heat exchangers 2 and includes a plurality of temperature adjustment apparatuses 50 corresponding to respective ones of the plurality of indoor heat exchangers 2. Intermediary apparatus 107 may include any of the temperature adjustment apparatuses shown in FIGS. 3 to 6 and 13 instead of temperature adjustment apparatus 50. Since the configuration of components corresponding to intermediary apparatus 103 and the flow of the heating medium have been described in the second embodiment, description will not be repeated. Though FIG. 16 adopts the configuration of intermediary apparatus 103 in FIG. 9 for heat exchange in second heat exchanger 3, the configuration of intermediary apparatus 105 in FIG. 14 may be adopted.

A plurality of intermediary apparatuses are integrated in the sixth embodiment. Therefore, when a space for arranging individual intermediary apparatuses is not available around individual load apparatuses 102 but a space for arrangement can be secured at another location, the intermediary apparatus can be arranged.

Figure 17:
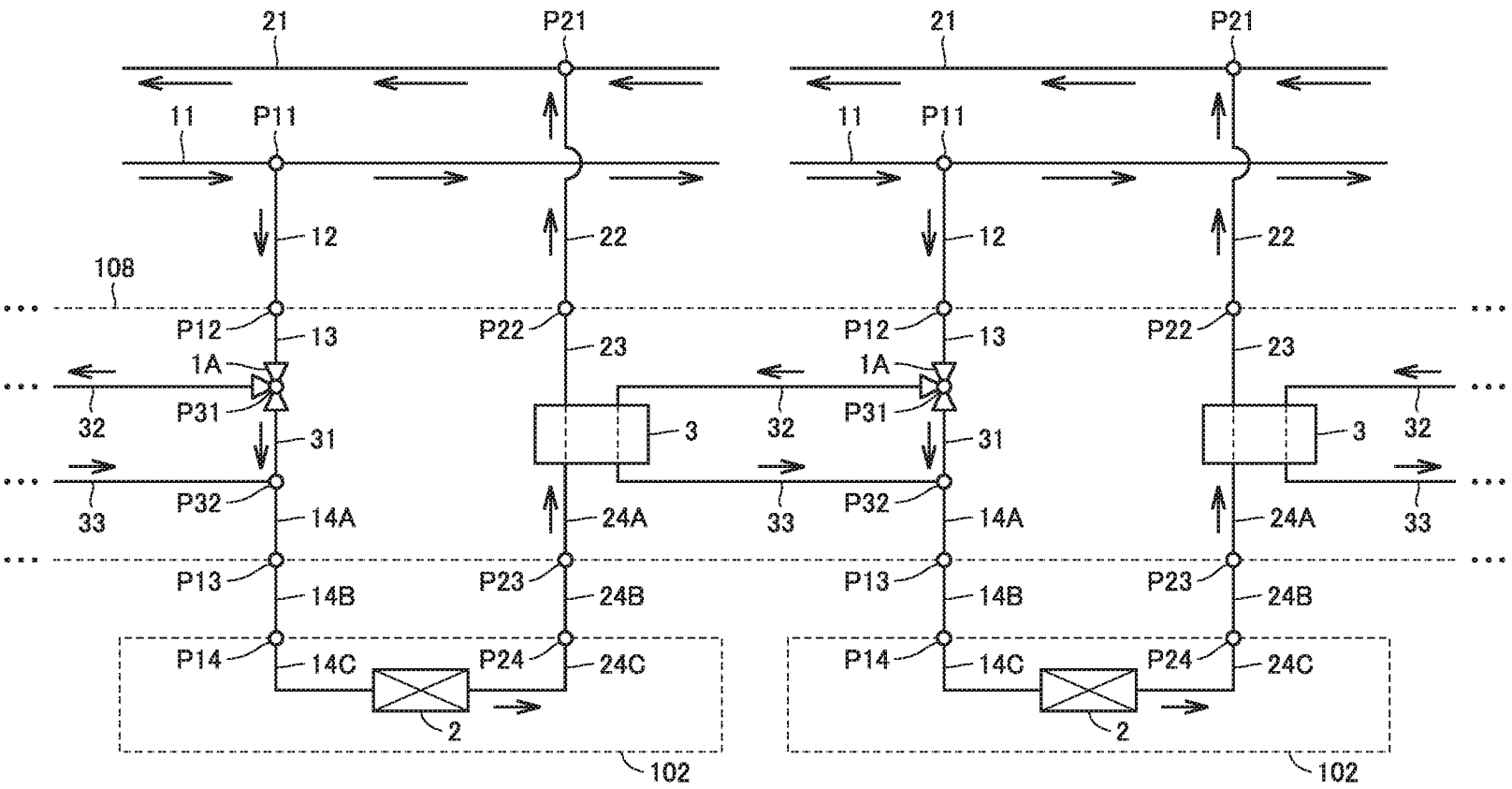
FIG. 17 is a diagram showing a circuit configuration of the load apparatus and an intermediary apparatus and a flow of a heating medium according to a modification of the sixth embodiment.

FIG. 17 is a diagram showing a circuit configuration of load apparatus 102 and an intermediary apparatus 108 and a flow of a heating medium according to a modification of the sixth embodiment.

The modification of the sixth embodiment includes intermediary apparatus 108 interposed between the trunk pipe and the plurality of load apparatuses in an example where the air-conditioning system includes a plurality of load apparatuses 102. Intermediary apparatus 108 is such that the heating medium that flows through branch pipe 32 connected to branch portion P31 of intermediary apparatus 107 according to the sixth embodiment is connected to second heat exchanger 3 in a different system and exchanges heat. The heating medium that has exchanged heat flows through branch pipe 33 and is merged in merge portion P32 in the original system with the heating medium that flows through branch pipe 31. The modification is similar to the sixth embodiment in configuration and flow of the heating medium except for heat exchange in second heat exchanger 3. Though FIG. 17 adopts the configuration of intermediary apparatus 103 in FIG. 9 for heat exchange in second heat exchanger 3, the configuration of intermediary apparatus 105 in FIG. 14 may be adopted.

Seventh Embodiment

Figure 18:
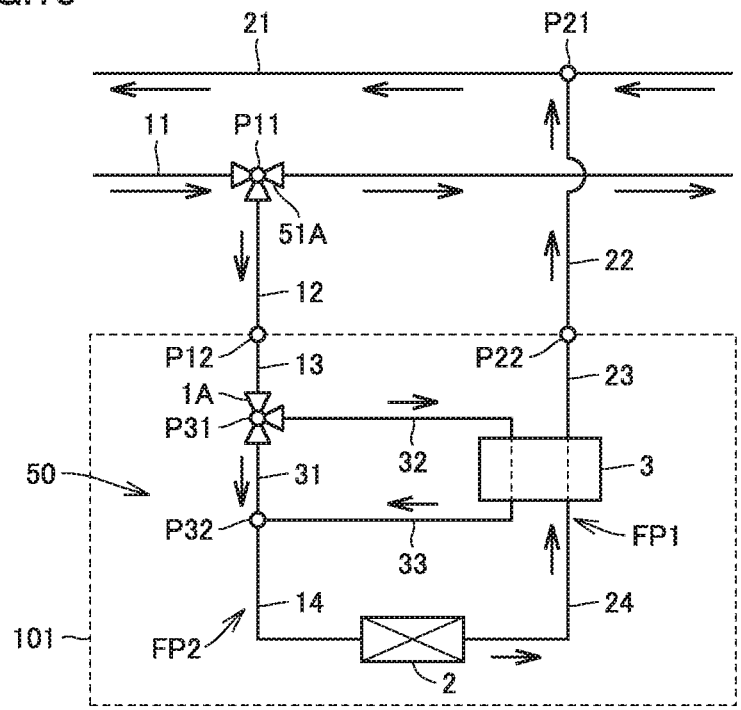
FIG. 18 is a diagram showing a circuit configuration of the load apparatus and a flow rate regulator and a flow of a heating medium according to a seventh embodiment.

FIG. 18 is a diagram showing a circuit configuration of a load apparatus and a flow of a heating medium according to a seventh embodiment. In the seventh embodiment, a feature configured to regulate a flow rate of the heating medium that flows in is added to the load apparatus implemented in the first to sixth embodiments. Addition of this feature allows also regulation of a flow rate simultaneously with adjustment of a temperature of the heating medium and realizes simultaneous adjustment of a temperature and a humidity of a space to be air-conditioned.

In the seventh embodiment, the air-conditioning system includes a flow rate distribution valve 51A configured to regulate a flow rate of the heating medium that flows to indoor heat exchanger 2. As shown in FIG. 1, the heating medium is supplied from heat source apparatus CS to the plurality of load apparatuses 101-1 to **101-*n* through trunk pipes 11 and 21. Any one of load apparatuses 101-1 to 101-*n* falls under indoor heat exchanger 2 and others fall under load apparatuses configured to perform cooling by using the heating medium. Though FIG. 18 shows a configuration in which flow rate distribution valve 51A is provided in main branch portion P11 of trunk pipe 11, modification as shown in FIGS. 19 to 21** may be made.

Figure 19:
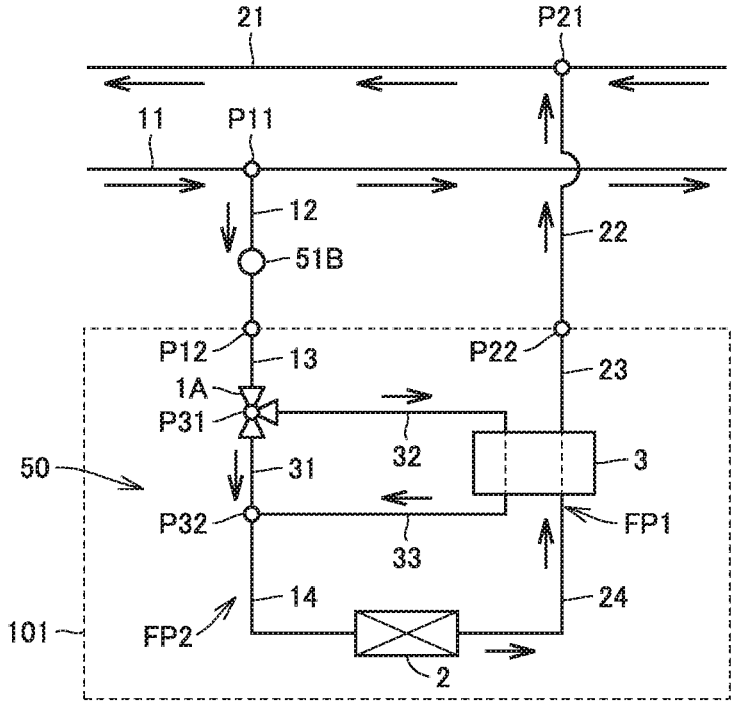
FIG. 19 is a diagram showing a configuration of a first modification of the load apparatus and the flow rate regulator according to the seventh embodiment.

In the example shown in FIG. 19, in addition to flow rate distribution valve 1A, a flow rate regulation valve 51B (a second flow rate regulation valve) arranged in pipe 12 between pipe FP2 and trunk pipe 11 is further provided. Flow rate regulation valve 51B may be arranged in pipe 22 between pipe FP1 and trunk pipe 21.

Figure 20:
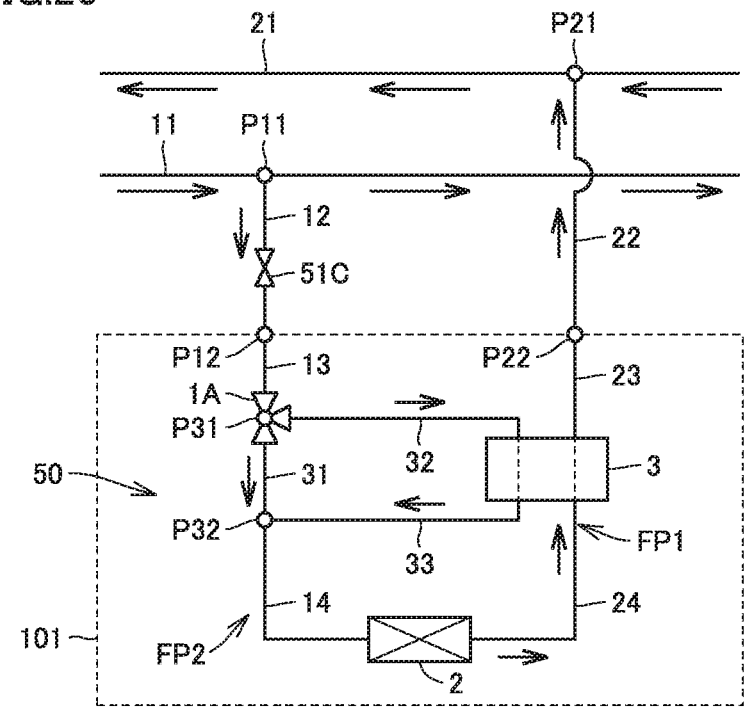
FIG. 20 is a diagram showing a configuration of a second modification of the load apparatus and the flow rate regulator according to the seventh embodiment.

In the example shown in FIG. 20, in addition to flow rate distribution valve 1A, a cut-off valve 51C (a second cut-off valve) arranged in pipe 12 between pipe FP2 and trunk pipe 11 and configured to perform an intermittent operation is further provided. Cut-off valve 51C may be arranged in pipe 22 between pipe FP1 and trunk pipe 21.

Figure 21:
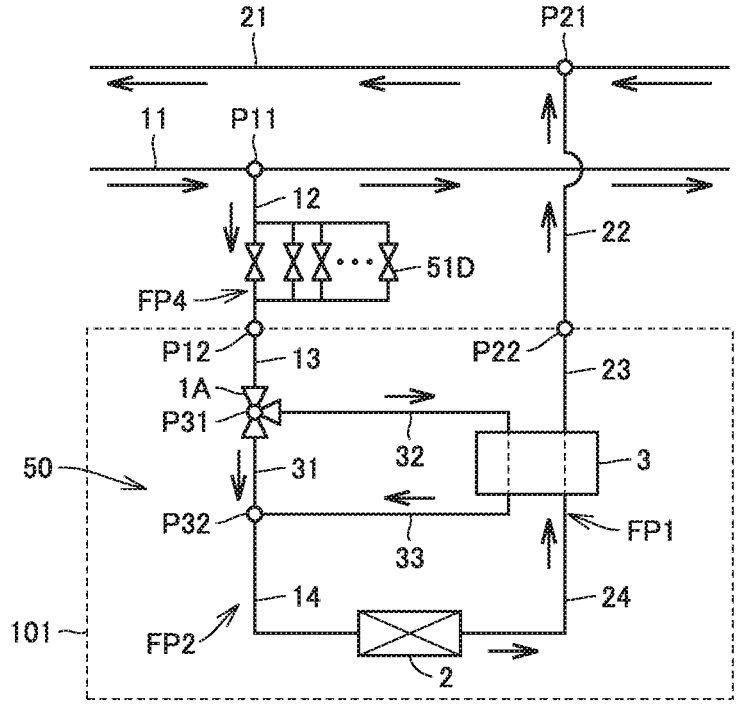
FIG. 21 is a diagram showing a configuration of a third modification of the load apparatus and the flow rate regulator according to the seventh embodiment.

In the example shown in FIG. 21, in addition to flow rate distribution valve 1A, a plurality of pipes FP4 arranged between pipe FP2 and trunk pipe 11 and connected in parallel to one another and a plurality of cut-off valves 51D provided in respective ones of the plurality of pipes FP4 are further provided. The plurality of pipes FP4 and the plurality of cut-off valves 51D may be arranged between pipe FP1 and trunk pipe 21.

Though the flow rate regulator in each of FIGS. 19 to 21 is shown as being provided in pipe 12, it may be provided in any of pipes 13, 14, and 22 to 24.

Though FIGS. 18 to 21 each show an example in which the flow rate regulator is added to load apparatus 101 in the first embodiment, a similar flow rate regulator may be arranged in the second to sixth embodiments.

Eighth Embodiment

Figure 22:
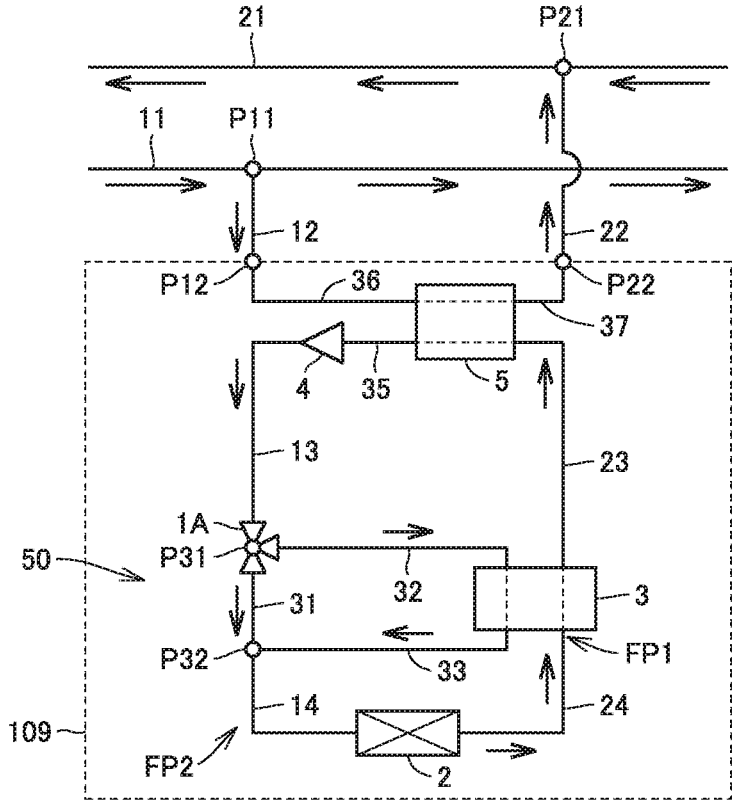
FIG. 22 is a diagram showing a circuit configuration of the load apparatus and a flow of a heating medium according to an eighth embodiment.

FIG. 22 is a diagram showing a circuit configuration of a load apparatus 109 and a flow of a heating medium according to an eighth embodiment.

Referring to FIG. 22, load apparatus 109 includes a pump 4, temperature adjustment apparatus 50, indoor heat exchanger 2, and a third heat exchanger 5, and includes a circuit configured to circulate the heating medium in the order of pump 4, branch portion P31, merge portion P32, indoor heat exchanger 2, second heat exchanger 3, and third heat exchanger 5 and a flow path from trunk pipe 11 via liquid inlet P12 of load apparatus 109, third heat exchanger 5, and liquid outlet P22 of load apparatus 109 to trunk pipe 21.

The circuit starting from pump 4 includes pipe 13 that connects pump 4 and branch portion P31 to each other, branch pipe 31 that connects branch portion P31 and merge portion. P32 to each other, branch pipe 32 that connects branch portion P31 and second heat exchanger 3 to each other, branch pipe 33 that connects second heat exchanger 3 and merge portion P32 to each other, pipe 14 that connects merge portion P32 and indoor heat exchanger 2 to each other, pipe 24 that connects indoor heat exchanger 2 and second heat exchanger 3 to each other, pipe 23 that connects second heat exchanger 3 and third heat exchanger 5 to each other, and a pipe 35 that connects third heat exchanger 5 and the pump to each other.

The flow path starting from liquid inlet P12 of load apparatus 109 includes a pipe 36 that connects liquid inlet P12 of load apparatus 109 and third heat exchanger 5 to each other and a pipe 37 that connects third heat exchanger 5 and liquid outlet P22 of load apparatus 109 to each other.

Temperature adjustment apparatus 50 includes a flow rate regulator configured to regulate the flow rate at which the heating medium that flows from pipe 13 into branch portion P31 flows as being split into the heating medium to branch pipe 31 and the heating medium to branch pipe 32. Though FIG. 22 shows such a configuration that flow rate distribution valve 1A is provided in branch portion P31, modification as shown in FIGS. 3 to 6 may be made. Though the flow rate regulator in each of FIGS. 3 to 6 is shown as being provided in branch pipe 32, it may be provided in branch pipe 33. Though FIG. 22 shows a configuration similar to that in FIG. 2 in the first embodiment for heat exchange in second heat exchanger 3, the configuration similar to that in FIG. 13 in the third embodiment may be applicable.

Load apparatus 109 is connected to trunk pipes 11 and 21 of the air-conditioning system at two locations of liquid inlet P12 and liquid outlet P22 of load apparatus 109. Liquid inlet P12 of load apparatus 109 is connected to pipe 12 branched off in main branch portion P11 from trunk pipe 11 through which the heating medium for the air-conditioning system flows. Liquid outlet P22 of load apparatus 109 is connected to pipe 22 branched off in main merge portion. P21 from trunk pipe 21 through which the heating medium for the air-conditioning system flows.

A flow of the heating medium will be described with reference to FIG. 22. An arrow shown in FIG. 22 indicates a direction of flow of the heating medium.

The heating medium delivered from pump WP in FIG. 1 flows through trunk pipe 11. Some of the heating medium that flows through trunk pipe 11 reaches liquid inlet P12 of load apparatus 109 through pipe 12 branched off in main branch portion P11. The heating medium that has reached liquid inlet P12 of load apparatus 109 flows through pipe 36 and flows into third heat exchanger 5. The heating medium that has flowed into third heat exchanger 5 exchanges heat with the heating medium on a use side of the load apparatus and cools the heating medium on the use side. The heating medium that has exchanged heat with the heating medium on the use side in third heat exchanger 5 flows through pipe 37 and reaches liquid outlet P22 of load apparatus 109. The heating medium that has reached liquid outlet P22 of load apparatus 109 flows through pipe 22 and flows out of load apparatus 109. The heating medium that flows through pipe 22 is merged in main merge portion P21 with the heating medium that flows through trunk pipe 21. The heating medium merged in trunk pipe 21 flows to heat source apparatus CS in FIG. 1 and is cooled again.

Though FIG. 22 shows an example where water or brine is adopted as the heating medium that flows through trunk pipes 11 and 21, a refrigeration cycle using gas refrigerant may be adopted as the heat source apparatus in the eighth embodiment. In this case, refrigerant is conveyed by a compressor rather than pump WP and it becomes low-pressure refrigerant in an expansion apparatus provided in any of trunk pipes 11, 12, and 36 or outside of the shown area, flows into third heat exchanger 5, and exchanges heat with the heating medium on the use side.

The heating medium delivered from pump 4 flows through pipe 13 and reaches branch portion P31. The heating medium that has reached branch portion P31 flows as being split into the heating medium in branch pipe 31 and the heating medium in branch pipe 32. The heating medium in pipe FP2 that flows through branch pipe 32 increases in temperature by exchanging in second heat exchanger 3, heat with the heating medium in pipe FP1 downstream from indoor heat exchanger 2. The heating medium that has increased in temperature flows through branch pipe 33 and reaches merge portion. P32. The remaining heating medium that flows through branch pipe 31 reaches merge portion P32 and increases in temperature by being mixed with the heating medium that flows through branch pipe 33. The heating medium that has reached merge portion P32 flows through pipe 14 and flows into indoor heat exchanger 2.

The heating medium that has flowed into indoor heat exchanger 2 cools the space to be air-conditioned by exchanging heat with air. The heating medium that has exchanged heat with air in indoor heat exchanger 2 increases in temperature, passes through pipe 24, and flows into second heat exchanger 3. The heating medium that has flowed into second heat exchanger 3 lowers in temperature by exchanging heat with the heating medium in pipe FP2 on the upstream side. The heating medium that has lowered in temperature flows through pipe 23 and flows into third heat exchanger 5. The heating medium that has flowed into third heat exchanger 5 lowers in temperature by exchanging heat with the heating medium that flows through pipe 36 branched off from trunk pipe 11. The heating medium that has lowered in temperature reaches pump 4 via pipe 35 and is again delivered to pipe 13.

Figure 23:
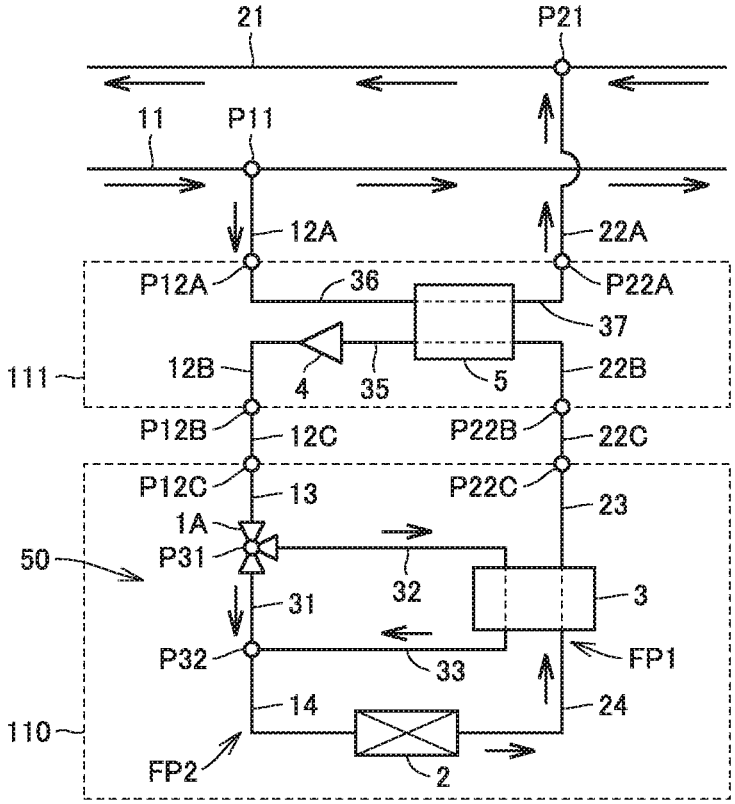
FIG. 23 is a diagram showing a modification of the circuit configuration according to the eighth embodiment.

Though FIG. 22 shows a configuration in Which features in the eighth embodiment are accommodated in a single load apparatus 109, they may be accommodated in a load apparatus 110 and an intermediary apparatus 111 as being grouped as in FIG. 23. Single intermediary apparatus 111 may accommodate components of intermediary apparatuses in a plurality of systems as in FIG. 16 shown in the sixth embodiment.

In the eighth embodiment, by employing pump 4 of which number of rotations is variable, pump 4 performs a flow rate regulation function. Therefore, simultaneous adjustment of a temperature and a humidity of a space to be air-conditioned can be achieved as in the seventh embodiment.

By further including an apparatus configured to regulate a flow rate of the heating medium that flows to third heat exchanger 5 in the circuit in FIG. 22, a range within which a temperature and a humidity of a space to be air-conditioned can be adjusted can be expanded. A configuration may be such that flow rate distribution valve 51A is provided in main branch portion P11 of trunk pipe 11 as in FIG. 18 in the seventh embodiment, such that flow rate regulation valve 51B is provided in pipe 12 as in FIG. 19, such that cut-off valve 51C capable of an intermittent operation is provided in pipe 12 as in FIG. 20, or such that pipe 12 is branched into pipes in parallel and cut-off valve 51D is provided in each pipe as in FIG. 21, and such a flow rate regulator may be provided in any of pipes 12, 22, 36, and 37.

Ninth Embodiment

Figure 24:
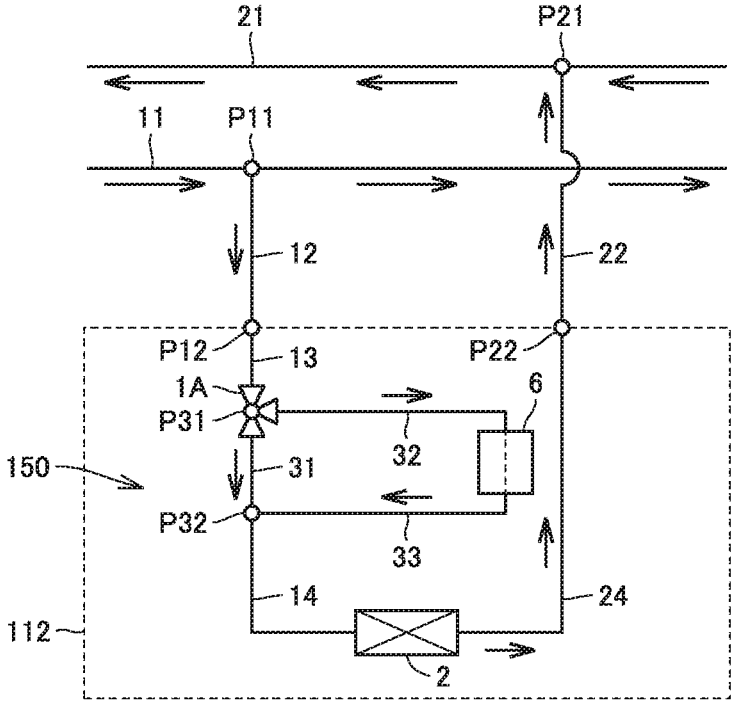
FIG. 24 is a diagram showing a circuit configuration of a load apparatus and a flow of a heating medium according to a ninth embodiment.
Figure 25:
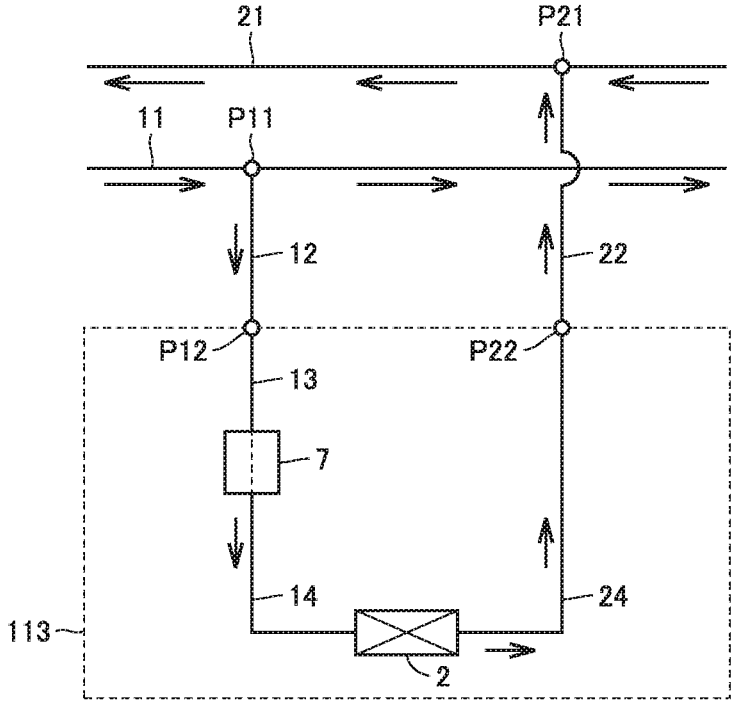
FIG. 25 is a diagram showing a configuration of a modification of a load apparatus according to the ninth embodiment.

FIG. 24 is a diagram showing a circuit configuration of a load apparatus and a flow of a heating medium according to a ninth embodiment. A load apparatus 112 shown in FIG. 24 includes a heater 6 instead of second heat exchanger 3 in the configuration of load apparatus 101 in the first embodiment shown in FIG. 1. By modifying the configuration, pipe 24 connects indoor heat exchanger 2 and liquid outlet P22 of load apparatus 112 to each other. Since the configuration and the flow of the heating medium are otherwise similar to those in the first embodiment, description will not be repeated. When a quantity of heat of heater 6 in FIG. 24 is variable, a configuration thereof may be simplified like a heater 7 of a load apparatus 113 shown in FIG. 25. According to the configuration, electric power consumed by the heater is necessary. Therefore, though an effect of energy saving is lowered, an effect for suppressing discomfort due to lowering in humidity of an indoor space can sufficiently be expected.

By further providing a mechanism configured to regulate a flow rate of the heating medium that flows to indoor heat exchanger 2, a temperature and a humidity of a space to be air-conditioned can simultaneously be adjusted.

A configuration for regulating a flow rate may be such that flow rate distribution valve 51A is provided in main branch portion P11 of trunk pipe 11 as in FIG. 18 in the seventh embodiment, such that flow rate regulation valve 51B is provided in pipe 12 as in FIG. 19, such that cut-off valve 51C capable of an intermittent operation is provided in pipe 12 as in FIG. 20, or such that pipe 12 is branched into pipes in parallel and cut-off valve 51D is provided in each pipe as in FIG. 21. Such a regulation mechanism may be provided in any of pipes 13, 14, 22, and 24.

Each embodiment is applicable also to a refrigeration cycle apparatus. The refrigeration cycle apparatus is an apparatus including an intermediary apparatus and a heat source apparatus or an apparatus including a load apparatus and a heat source apparatus, and represented by an air-conditioning apparatus. Examples of the refrigeration cycle apparatus, however, can include a showcase, a refrigerator, a freezer, a refrigerating storage, and a cold storage.

It should be understood that the embodiments disclosed herein are illustrative and non-restrictive in every respect. The scope of the present invention is defined by the terms of the claims rather than the description of the embodiments above and is intended to include any modifications within the scope and meaning equivalent to the terms of the claims.

REFERENCE SIGNS LIST

1 flow rate regulator; 1A, 51A flow rate distribution valve; 1B, 51B flow rate regulation valve; 1C, 1D, 51C, 51D cut-off valve; 2 indoor heat exchanger; 3 second heat exchanger; 4, WP pump; 5 third heat exchanger; 6 heater; 11, 21, 21A, 21B trunk pipe; 12 to 14, 14A to 14C, 22 to 24, 24A to 24C, 35 to 37, 41, FP1B, FP1, FP2, FP4 pipe; 31 to 34 branch pipe; 42 component; 50, 50F temperature adjustment apparatus; 51 controller; 52 temperature sensor; 101, 102, 104, 109, 110, 112 load apparatus; 103, 105, 106, 107, 108, 111 intermediary apparatus; 1000 air-conditioning system; CS heat source apparatus; FCU1 to FCU1 fan coil unit, P11 main branch portion; P12, P14, P23 liquid inlet; P13, P22, P24 liquid outlet; P21 main merge portion; P31 branch portion; P32 merge portion; R1 to Rn room

The invention claimed is:

1. A system configured to adjust a temperature of a heating medium that exchanges heat with air in a plurality of indoor heat exchangers connected to a heat source apparatus, the plurality of indoor heat exchangers arranged in different rooms, wherein one temperature adjustment apparatus is provided for each one of the plurality of indoor heat exchangers, each temperature adjustment apparatus comprising:

a first pipe through which the heating medium flows;

a second pipe through which the heating medium flows, the second pipe being branched into a first branch pipe and a second branch pipe, the first branch pipe and the second branch pipe being thereafter merged again;

a second heat exchanger in which heat is exchanged between the heating medium that flows through the first branch pipe and the heating medium that flows through the first pipe;

a flow rate regulator configured to change a flow rate of the heating medium that flows through the first branch pipe and a flow rate of the heating medium that flows through the second branch pipe; and a controller, one of the first pipe and the second pipe being a pipe configured to supply the heating medium from the heat source apparatus to the indoor heat exchanger and the other of the first pipe and the second pipe being a pipe configured to return the heating medium from the indoor heat exchanger to the heat source apparatus, the controller is configured to control the flow rate regulator to control a ratio of the flow rate of the heating medium that flows through the first branch pipe and the flow rate of the heating medium that flows through the second branch pipe based on a temperature set for the room.

2. The system according to claim 1, wherein the flow rate regulator comprises a first flow rate distribution valve arranged at a branch portion where the first branch pipe and the second branch pipe are branched off or a merge portion where the first branch pipe and the second branch pipe are merged, the first flow rate distribution valve being configured to change a ratio between the flow rate of the heating medium that flows through the first branch pipe and the flow rate of the heating medium that flows through the second branch pipe.

3. The system according to claim 1, wherein the flow rate regulator comprises a first flow rate regulation valve arranged in the first branch pipe or the second branch pipe, the first flow rate regulation valve being configured to change a ratio between the flow rate of the heating medium that flows through the first branch pipe and the flow rate of the heating medium that flows through the second branch pipe.

4. The system according to claim 1, wherein the flow rate regulator comprises a first cut-off valve arranged in the first branch pipe or the second branch pipe and configured to perform an intermittent operation.

5. The system according to claim 1, wherein the second pipe comprises a plurality of third branch pipes arranged in parallel, the plurality of third branch pipes are structured to be branched off from the first branch pipe and merged again with the first branch pipe, and the heating medium that flows through the plurality of third branch pipes exchanges heat with the heating medium that flows through the first pipe in the second heat exchanger, and the flow rate regulator comprises a plurality of first cut-off valves provided in respective ones of the plurality of third branch pipes.

6. The system according to claim 5, wherein the second heat exchanger is configured to be different in amount of heat exchange for each of the plurality of third branch pipes.

7. The system according to claim 1, wherein the heating medium is supplied from the heat source apparatus through a trunk pipe to a load apparatus having the indoor heat exchanger and configured to perform cooling by using the indoor heat exchanger and the heating medium, and the flow rate regulator further comprises a flow rate regulation valve arranged between the first pipe or the second pipe and the trunk pipe.

8. The system according to claim 1, wherein the heating medium is supplied from the heat source apparatus through a trunk pipe to a load apparatus having the indoor heat exchanger and configured to perform cooling by using the indoor heat exchanger and the heating medium, and the flow rate regulator further comprises a cut-off valve arranged between the first pipe or the second pipe and the trunk pipe and configured to perform an intermittent operation.

9. The system according to claim 1, wherein the heating medium is supplied from the heat source apparatus through a trunk pipe to a load apparatus having the indoor heat exchanger and configured to perform cooling by using the indoor heat exchanger and the heating medium, and the flow rate regulator comprises a plurality of fourth pipes arranged between the first pipe or the second pipe and the trunk pipe and connected in parallel, and a plurality of cut-off valves provided in respective ones of the plurality of fourth pipes.

10. The system according to claim 1, wherein the heating medium is supplied from the heat source apparatus through a first trunk pipe to a load apparatus having the indoor heat exchanger and configured to perform cooling by using the indoor heat exchanger and the heating medium, and the heating medium is returned to the heat source apparatus through a second trunk pipe, one of the first pipe and the second pipe is a part of one of the first trunk pipe and the second trunk pipe, and the other of the first pipe and the second pipe is a pipe branched off from the other of the first trunk pipe and the second trunk pipe and configured to supply the heating medium to the indoor heat exchanger.

11. The system according to claim 1, further comprising an intermediary apparatus, the intermediary apparatus being arranged between a trunk pipe for the heating medium and the indoor heat exchanger, the heating medium being supplied from the heat source apparatus through the trunk pipe to a load apparatus having the indoor heat exchanger and configured to perform cooling by using the indoor heat exchanger and the heating medium.

12. The system according to claim 1, further comprising an intermediary apparatus, the intermediary apparatus having a plurality of the temperature adjustment apparatuses, the heating medium being supplied from the heat source apparatus through a trunk pipe to the plurality of the indoor heat exchangers, the intermediary apparatus being arranged between the trunk pipe for the heating medium and the plurality of the indoor heat exchangers.

13. The system according to claim 1, further comprising a refrigeration cycle apparatus; and the heat source apparatus.

14. The system according to claim 1, further comprising a load apparatus; and for each of the temperature adjustment apparatuses, the indoor heat exchanger.

15. The system according to claim 1, further comprising a refrigeration cycle apparatus;

a load apparatus; and the heat source apparatus.

* * * * *